US012312951B1

(12) United States Patent
Camargo et al.

(10) Patent No.: US 12,312,951 B1
(45) Date of Patent: May 27, 2025

(54) FRACTURE REACTIVATION INDEX (FRI) FOR SEAL INTEGRITY ANALYSIS IN CARBON CAPTURE AND STORAGE (CCS)

(71) Applicant: Saudi Arabian Oil Company, Dhahran (SA)

(72) Inventors: Otto Meza Camargo, Dhahran (SA); Waheed Arshad, Dhahran (SA); Karla Olvera Carranza, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/647,538

(22) Filed: Apr. 26, 2024

(51) Int. Cl.
*E21B 49/00* (2006.01)
*E21B 43/26* (2006.01)

(52) U.S. Cl.
CPC ..... *E21B 49/008* (2013.01); *E21B 43/26* (2013.01); *E21B 2200/20* (2020.05)

(58) Field of Classification Search
None
See application file for complete search history.

(56) References Cited

U.S. PATENT DOCUMENTS 6,502,037 B1 12/2002 Jorgensen et al.
6,705,398 B2 3/2004 Weng
6,904,365 B2 6/2005 Bratton et al.
7,025,138 B2 4/2006 Kurkjian et al.
7,042,802 B2 5/2006 Sinha
7,337,660 B2 3/2008 Ibrahim et al.
7,457,194 B2 11/2008 Prioul et al.
7,526,385 B2 4/2009 Sayers
7,562,278 B2 7/2009 Lyakh et al.
7,565,278 B2 7/2009 Li et al.
7,679,993 B2 3/2010 Sayers
(Continued)

FOREIGN PATENT DOCUMENTS

AU 2013374225 B2 7/2014
AU 2018267575 B9 12/2018
(Continued)

OTHER PUBLICATIONS

Jiang, Le et al.; "Simulation and Optimization of Dynamic Fracture Parameters for an Inverted Square Nine-Spot Well Pattern in Tight Fractured Oil Reservoirs" Hindawi, Geofluids, vol. 2020, Article ID 8883803; pp. 1-9.
(Continued)

*Primary Examiner* — Kenneth L Thompson
(74) *Attorney, Agent, or Firm* — Bracewell LLP; Constance G. Rhebergen; Brian H. Tompkins

(57) ABSTRACT

A determination of caprock integrity in naturally fractured reservoirs for fluid injection such as carbon capture and storage (CCS). The caprock integrity and seal integrity is determined via a fracture reactivation index (FRI). A mechanical earth model is determined to quantify the minimum principal in-situ stress in the caprock to determine the injection pressure limits and safeguard against undesired breakthrough into adjacent zones. A fracture model is generated using the mechanical earth model, and a critical stress analysis may be performed. After determination of a fracture density index and Coulomb Excessive Failure Function (CEFF), the fracture reactivation index (FRI) is determined.

14 Claims, 12 Drawing Sheets
(9 of 12 Drawing Sheet(s) Filed in Color)

(56) References Cited

U.S. PATENT DOCUMENTS

| | | | |
|---|---|---|---|
| 7,707,018 | B2 | 4/2010 | Shaw |
| 7,941,307 | B2 | 5/2011 | Symington et al. |
| 8,010,294 | B2 | 8/2011 | Dorn et al. |
| 8,024,124 | B2 | 9/2011 | Sayers |
| 8,041,510 | B2 | 10/2011 | Dasgupta |
| 8,078,405 | B2 | 12/2011 | Delorme |
| 8,121,792 | B2 | 2/2012 | Hsu et al. |
| 8,204,727 | B2 | 6/2012 | Dean et al. |
| 8,275,589 | B2 | 9/2012 | Montaron et al. |
| 8,301,427 | B2 | 10/2012 | Souche et al. |
| 8,374,836 | B2 | 2/2013 | Yogeswaren |
| 8,498,848 | B2 | 7/2013 | Habashy et al. |
| 8,619,500 | B2 | 12/2013 | Gray |
| 8,756,016 | B2 | 6/2014 | Tabanou et al. |
| 8,780,671 | B2 | 7/2014 | Sayers |
| 8,898,046 | B2 | 11/2014 | Moos et al. |
| 9,022,140 | B2 | 5/2015 | Marx et al. |
| 9,062,545 | B2 | 6/2015 | Roberts et al. |
| 9,063,251 | B2 | 6/2015 | Moos |
| 9,068,448 | B2 | 6/2015 | Hui et al. |
| 9,110,190 | B2 | 8/2015 | Yogeswaren |
| 9,152,745 | B2 | 10/2015 | Glinsky |
| 9,305,121 | B2 | 4/2016 | Yao et al. |
| 9,390,204 | B2 | 7/2016 | Bowen et al. |
| 9,417,348 | B2 | 8/2016 | Lin |
| 9,435,192 | B2 | 9/2016 | Lawrence et al. |
| 9,465,140 | B2 | 10/2016 | Crawford et al. |
| 9,618,652 | B2 | 4/2017 | Weng et al. |
| 9,677,393 | B2 | 6/2017 | Morris |
| 9,846,260 | B2 | 12/2017 | Mallet |
| 9,988,895 | B2 | 6/2018 | Roussel et al. |
| 10,001,003 | B2 | 6/2018 | Dusseault et al. |
| 10,101,498 | B2 | 10/2018 | Berard et al. |
| 10,190,406 | B2 | 1/2019 | Holland et al. |
| 10,302,785 | B2 | 5/2019 | Dirksen et al. |
| 10,310,137 | B1 | 6/2019 | Mallet |
| 10,352,145 | B2 | 7/2019 | Maxwell et al. |
| 10,422,208 | B2 | 9/2019 | Weng et al. |
| 10,465,509 | B2 | 11/2019 | Yao et al. |
| 10,528,681 | B2 | 1/2020 | Yogeswaren |
| 10,563,493 | B2 | 2/2020 | Ganguly et al. |
| 10,571,605 | B2 | 2/2020 | Crawford et al. |
| 10,572,611 | B2 | 2/2020 | Huang et al. |
| 10,607,043 | B2 | 3/2020 | Camargo et al. |
| 10,724,346 | B2 | 7/2020 | Eftekhari Far et al. |
| 10,760,416 | B2 | 9/2020 | Weng et al. |
| 10,787,887 | B2 | 9/2020 | Pankaj et al. |
| 10,846,447 | B2 | 11/2020 | Myers et al. |
| 10,853,533 | B2 | 12/2020 | Plateaux et al. |
| 10,920,538 | B2 | 2/2021 | Rodriguez Herrera et al. |
| 10,920,552 | B2 | 2/2021 | Rodriguez Herrera et al. |
| 11,098,582 | B1 | 8/2021 | Camargo et al. |
| 11,180,975 | B2 | 11/2021 | Renaudeau et al. |
| 11,313,994 | B2 | 4/2022 | Salman et al. |
| 11,353,621 | B2 | 6/2022 | Khan et al. |
| 11,434,759 | B2 | 9/2022 | Awan et al. |
| 11,599,790 | B2 | 3/2023 | Pandey et al. |
| 2007/0100594 | A1 | 5/2007 | Lamoureux-Var et al. |
| 2007/0255545 | A1 | 11/2007 | Pita et al. |
| 2007/0272407 | A1 | 11/2007 | Lehnman et al. |
| 2008/0071505 | A1 | 3/2008 | Huang et al. |
| 2009/0032250 | A1 | 2/2009 | Sarkar et al. |
| 2009/0299637 | A1 | 12/2009 | Dasgupta |
| 2009/0319243 | A1 | 12/2009 | Suarez-Rivera et al. |
| 2010/0138196 | A1 | 6/2010 | Hui et al. |
| 2010/0191470 | A1 | 7/2010 | Tabanou et al. |
| 2010/0250216 | A1 | 9/2010 | Narr et al. |
| 2012/0072188 | A1 | 3/2012 | Maerten et al. |
| 2013/0046524 | A1 | 2/2013 | Gathogo et al. |
| 2013/0282348 | A1* | 10/2013 | Liu ..... G01V 20/00 703/10 |
| 2013/0297269 | A1 | 11/2013 | Davies et al. |
| 2013/0299241 | A1 | 11/2013 | Alberty et al. |
| 2013/0312974 | A1 | 11/2013 | McClung, IV |
| 2014/0358510 | A1 | 12/2014 | Sarkar et al. |
| 2015/0129211 | A1 | 5/2015 | Dusseault et al. |
| 2015/0276979 | A1 | 10/2015 | Hugot et al. |
| 2015/0315485 | A1 | 11/2015 | Morris |
| 2016/0222765 | A1 | 8/2016 | Nooruddin et al. |
| 2016/0245939 | A1 | 8/2016 | Williams |
| 2016/0266274 | A1 | 9/2016 | Alqam et al. |
| 2016/0266278 | A1 | 9/2016 | Holderby et al. |
| 2016/0281498 | A1 | 9/2016 | Nguyen et al. |
| 2017/0051598 | A1 | 2/2017 | Ouenes |
| 2017/0052272 | A1 | 2/2017 | Maeso et al. |
| 2017/0132339 | A1 | 5/2017 | Umholtz et al. |
| 2017/0145793 | A1 | 5/2017 | Ouenes |
| 2017/0176228 | A1 | 6/2017 | Elisabeth |
| 2017/0205531 | A1 | 7/2017 | Berard et al. |
| 2017/0254909 | A1 | 9/2017 | Agharazi |
| 2017/0316128 | A1 | 11/2017 | Huang et al. |
| 2018/0203146 | A1 | 7/2018 | Den Boer et al. |
| 2019/0080122 | A1 | 3/2019 | Camargo et al. |
| 2019/0345815 | A1 | 11/2019 | Mishra |
| 2019/0360330 | A1* | 11/2019 | Wheeler ..... E21B 49/008 |
| 2020/0056460 | A1 | 2/2020 | Isaev et al. |
| 2020/0095858 | A1 | 3/2020 | Bouaouaja et al. |
| 2020/0141215 | A1 | 5/2020 | Crews et al. |
| 2020/0225382 | A1 | 7/2020 | Mallet et al. |
| 2020/0225383 | A1 | 7/2020 | Mallet et al. |
| 2020/0326322 | A1 | 10/2020 | Farrukh Hamza |
| 2021/0054736 | A1 | 2/2021 | Moos et al. |
| 2021/0102461 | A1 | 4/2021 | Kumar et al. |
| 2021/0132246 | A1 | 5/2021 | Liu et al. |
| 2021/0140313 | A1 | 5/2021 | Busetti |
| 2021/0222518 | A1 | 7/2021 | Bardy et al. |
| 2021/0350052 | A1 | 11/2021 | Alwahtani et al. |
| 2022/0018245 | A1 | 1/2022 | Coenen |
| 2022/0291418 | A1 | 9/2022 | Noufal |
| 2023/0012429 | A1 | 1/2023 | Camargo et al. |
| 2023/0084141 | A1 | 3/2023 | Camargo et al. |
| 2023/0333278 | A1 | 10/2023 | Camargo et al. |

FOREIGN PATENT DOCUMENTS

| | | | |
|---|---|---|---|
| BR | PI1003737 | A2 | 3/2012 |
| CA | 2778313 | A1 | 6/2011 |
| CA | 2904008 | A1 | 9/2014 |
| CA | 2932670 | A1 | 12/2017 |
| CA | 3043231 | A1 | 6/2018 |
| CN | 102042010 | B | 1/2014 |
| CN | 102788994 | B | 1/2015 |
| CN | 104459775 | B | 3/2015 |
| CN | 104500050 | A | 5/2015 |
| CN | 105403929 | A | 3/2016 |
| CN | 105484741 | A | 4/2016 |
| CN | 103064114 | B | 5/2016 |
| CN | 106285659 | A | 1/2017 |
| CN | 104615896 | B | 5/2017 |
| CN | 106971269 | A | 7/2017 |
| CN | 104992468 | B | 1/2018 |
| CN | 105134156 | B | 5/2018 |
| CN | 108331555 | A | 7/2018 |
| CN | 107578343 | B | 7/2020 |
| CN | 107577831 | B | 8/2020 |
| CN | 110850057 | B | 4/2021 |
| CN | 112253103 | B | 8/2021 |
| CN | 112065351 | B | 9/2021 |
| CN | 113534291 | A | 10/2021 |
| CN | 109102180 | B | 11/2021 |
| CN | 112526107 | B | 11/2021 |
| CN | 109388817 | B | 2/2022 |
| CN | 114153002 | A | 3/2022 |
| CN | 115166853 | A | 10/2022 |
| CN | 115618274 | A | 1/2023 |
| EP | 3118758 | A1 | 1/2017 |
| EP | 2179134 | B1 | 1/2018 |
| EP | 3074957 | B1 | 2/2022 |
| EP | 4042211 | | 8/2022 |
| FR | 2979016 | A | 2/2013 |
| KR | 101620506 | B1 | 5/2016 |
| KR | 101811858 | B1 | 12/2017 |
| KR | 102111207 | B1 | 5/2020 |
| RU | 2404359 | C2 | 11/2010 |

(56) References Cited

FOREIGN PATENT DOCUMENTS

| | | | |
|---|---|---|---|
| WO | 2010111398 | A2 | 9/2010 |
| WO | 2013169256 | A1 | 11/2013 |
| WO | 2015168417 | A1 | 11/2015 |
| WO | 2016122792 | A1 | 8/2016 |
| WO | 2016209822 | A1 | 12/2016 |
| WO | 2017019388 | A1 | 2/2017 |
| WO | 2017216594 | A1 | 12/2017 |
| WO | 2019238451 | A1 | 12/2019 |
| WO | 2020167282 | A1 | 8/2020 |
| WO | 2020198210 | A1 | 10/2020 |
| WO | 2021108439 | A1 | 6/2021 |
| WO | 2021236877 | A1 | 11/2021 |
| WO | 2023130074 | A1 | 7/2023 |
| WO | 2024003599 | A1 | 1/2024 |

OTHER PUBLICATIONS

Jorgensen, Bo Barker et al.; "Bacterial Sulfate Reduction Above 100C in Deep-Sea Hydrothermal Vent Sediments" (Abstract only) Science, vol. 258, Issue 5089, Dec. 11, 1992; pp. 1756-1757.

Kayode, B. et al.; "Advances in Reservoir Modeling: A New Approach for Building Robust Reservoir Models" (abstract only) SPE-187993-MS, SPE KSA Annual Technical Symposium and Exhibition, Dammam, Saudi Arabia, Apr. 2017; pp. 1-6.

Khadivi, Kourosh et al.; "Integrated fracture characterization of Asmari reservoir in Haftkel field" Journal of Petroleum Exploration and Production Technology, Jan. 4, 2022; pp. 1-21.

Koutsabeloulis, N.C. et al.; "Numerical geomechanics in reservoir engineering" Computer Methods and Advances in Geomechanics, A.A. Balkema, Rotterdam, The Netherlands, 1994; pp. 2097-2104.

Lei, Qinghua et al.; "The use of discrete fracture networks for modelling coupled geomechanical and hydrological behaviour of fracture rocks" Computers and Geotechnics 85 (2017); pp. 151-176.

Liu, Naizhen et al.; "Shale gas sweet spot identification and precise geo-steering drilling in Weiyuan Block of Sichuan Basin, SW China" Petroleum Exploration and Development, vol. 43, Issue 6, Dec. 2016; pp. 1-9.

Liu, Shiqi et al.; "Geological and Engineering Integrated Shale Gas Sweet Spots Evaluation Based on Fuzzy Comprehensive Evaluation Method: A Case Study of Z Shale Gas Field HB Block" Energies 2022, 15, 602, Jan. 14, 2022; pp. 1-20.

Luthi, S.M. et al.; "Fracture apertures from electrical borehole scans" Geophysics, vol. 55, No. 7 (Jul. 1990); pp. 821-833.

Maerten, F.; "Adaptive cross-approximation applied to the solution of system of equations and post-Processing for 3D elastostatic problems using the boundary element Method" Engineering Analysis with Boundary Elements 34, 2010; pp. 483-491.

Matyasik, Irena et al.; "Genesis of hydrogen sulfide in carbonate reservoirs" NAFTA-GAZ, ROK LXXIV, NR Sep. 2018; pp. 627-635.

Meng, Fanle et al.; "Numerical Simulation of Fracture Flow Interaction Based on Discrete Fracture Model" Processes (2023), 11, 3013; pp. 1-19.

Meza, O. et al.; "Integration of Borehole Image Logs and Rock Mechanics for Critically Stressed Fractures Analysis in Weak Carbonates" (abstract only) 2nd EAGE Borehole Geology Workshop, Oct. 2017, vol. 2017; pp. 1-5.

Miller, Hugh G. et al.; "Potential field tilt—a new concept for location of potential field sources" Journal of Applied Geophysics 32 (1994); pp. 213-217.

Min, Ki-Bok et al.; "Stress-Dependent Permeability of Fractured Rock Masses: A Numerical Study" International Journal of Rock Mechanics and Mining Sciences, vol. 41, Issue 7 (2004); pp. 1191-1210.

Mojeddifar, Saeed et al.; "Porosity prediction from seismic inversion of a similarity attribute based on a pseudo-forward equation (PFE): a case study from the North Sea Basin, Netherlands" Pet. Sci. (2015) 12; pp. 428-442.

Nejadi, Siavash et al.; "History matching and uncertainty quantification of discrete fracture network models in fractured reservoirs" Journal of Petroleum Science and Engineering 152 (2017); pp. 21-32.

Nolte, K.G. et al.; "After-Closure Analysis of Fracture Calibration Tests" SPE 38676, 1997 SPE Annual Technical Conference and Exhibition, San Antonio, TX, Oct. 5-8, 1997; pp. 333-349.

Nvidia; "XGBoost—What Is It and Why Does it Matter?" available as of Aug. 3, 2023 at: https://www.nvidia.com/en-us/glossary/data-science/xgboost/; pp. 1-7.

Ochie, Karen Ifeoma et al.; "Geostatistics—Kriging and Co-Kriging Methods in Reservoir Characterization of Hydrocarbon Rock Deposits" SPE-193483-MS, Nigeria Annual International Conference & Exhibition, Lagos, Nigeria, Aug. 6-8, 2018; pp. 1-11.

Orr, Wilson L.; "Changes in Sulfur Content and Isotopic Ratios of Sulfur during Petroleum Maturation—Study of Big Horn Basin Paleozoic Oils" The American Association of Petroleum Geologists Bulletin, V. 58, No. 11 (Nov. 1974); pp. 2295-2318.

Ouenes, Ahmed; "Stress Modeling '3-G' Workflow Pinpoints Shale Sweet Spots" The American Oil & Gas Reporter, Jul. 2015; pp. 1-3.

Phillips, Jeffrey D. et al.; "Sources of Magnetic Anomalies over a Sedimentary Basin: Preliminary Results from the Coastal Plain of the Arctic National Wildlife Refuge, Alaska*" Geologic Apps of Gravity and Magnetics: Case Histories, 1998; pp. 130-134.

Phillips, Jeffrey D.; "Designing matched bandpass and azimuthal filters for the separation of potential-field anomalies by source region and source type" ASEG 15th Geophysical Conference and Exhibition, Aug. 2001, Brisbane; pp. 1-4.

Rezmer-Cooper, Iain M. et al.; "Real-Time Formation Integrity Tests Using Downhole Data" IADC/SPE 59123, 2000 IASC/SPE Drilling Conference, New Orleans, LA, Feb. 23-25, 2000; pp. 1-12.

Rogers S. et al., "Integrating discrete fracture network models and pressure transient data for testing conceptual fracture models of the Valhall chalk reservoir, Norway North Sea"; Geological Society, London, Special Publications, 270, 2007, pp. 187-197.

Rogers, Stephen F.; "Critical stress-related permeability in fractured rocks", Chpt 2, Fracture and In-Situ Stress Characterization of Hydrocarbon Reservoirs, (AMEEN) Geoscience World, The Geological Society of London, Jan. 1, 2003; pp. 7-16.

Schlumberger; "Welcome to Techlog online help 2018.2" 2018; pp. 1-2.

Schultz, Ryan et al.; "The Cardston Earthquake Swarm and Hydraulic Fracturing of the Exshaw Formation (Alberta Bakken Play)" Bulletin of the Seismological Society of America, vol. 105, No. 6, Dec. 2015; pp. 1-14.

Shimizu, Hiroyuki et al.; "A study of the effect of brittleness on hydraulic fracture complexity using a flow-coupled discrete element method" Journal of Petroleum Science & Engineering 160 (2018); pp. 372-383.

Silverman, B.W.; "Density Estimation for Statistics and Data Analysis" Monographs on Statistics and Applied Probability, London: Chapman and Hall, 1986; pp. 1-22.

Sorkhabi, Rasoul, Ph.D.; "Locating Sweet Spots: Shale Petroleum Systems" available as of Dec. 28, 2021 at: https://www.geoexpro.com/articles/2020/06/locating-sweet-spots-shale-petroleum-systems; vol. 17, No. 2-2020; pp. 1-10.

Spector, A. et al.; "Statistical Models for Interpreting Aeromagnetic Data" Geophysics, vol. 35, No. 2, Apr. 1970; pp. 293-302.

Tian, Fei et al.; "Three-Dimensional Geophysical Characterization of Deeply Buried Paleokarst System in the Tahe Oilfield, Tarim Basin, China" Water (2019) 11, 1045; pp. 1-18.

Tokhmchi, Behzad et al.; "Estimation of the fracture density in fractured zones using petrophysical logs" Journal of Petroleum Science and Engineering 72 (2010); pp. 206-213.

U.S. Appl. No. 16/792,742 (SA51284) titled "Determination of Calibrated Minimum Horizontal Stress Magnitude Using Fracture Closure Pressure and Multiple Mechanical Earth Model Realizations" filed Sep. 17, 2021.

U.S. Appl. No. 17/463,153 (SA51648) titled "Determining Hydrogen Sulfide (H2S) Concentration and Distribution in Carbonate Reservoirs Using Geomechanical Properties" filed Aug. 31, 2021.

U.S. Appl. No. 17/476,914 (SA51643) titled "Identifying Fluid Flow Paths in Naturally Fractured Reservoirs" filed Sep. 16, 2021.

(56) References Cited

OTHER PUBLICATIONS

U.S. Appl. No. 17/690,484 (SA51689) titled "Geo-Mechanical Based Determination of Sweet Spot Intervals for Hydraulic Fracturing Stimulation" filed Mar. 9, 2022.
U.S. Appl. No. 17/712,820 (SA51702) titled "System and Method to Develop Naturally Fractured Hydrocarbon Reservoirs Using a Fracture Density Index" filed Apr. 4, 2022.
Ahmadi, Mohammad Ali; "Toward Reliable Model for Prediction Drilling Fluid Density at Wellbore Conditions: A LSSVM Model" Department of Petroleum Engineering, Ahwaz Faculty of Petroleum Engineering; pp. 1-34.
Akhmetova, A.A. et al.; "Evaluation of the applicability mini-fracturing data to determine reservoir pressure and transmissibility (Russian)." OIJ 2018 (2018); pp. 90-94.
Aksenov, A.A. et al.; "Prediction of Distribution of Hydrogen Sulfide in Oil-Gas Basins" Petroleum Geology: A digest of Russian literature on Petroleum Geology; vol. 16 (1979), No. 10 (October); pp. 439-441.
Ai-Hawas, Khalid et al.; Delineation of fracture anisotropy signatures in Wudayhi Field by azimuthal seismic data; The Leading Edge, Interpreter's Corner, Dec. 2003; pp. 1202-1211.
Al-Nutaifi et al.; "Wellbore Instability Analysis for Highly Fractured Carbonate Gas Reservoir from Geomechanics Prospective, Saudi Arabia Case Study" International Petroleum Technology Conference, Kuala Lumpur, Malaysia, Dec. 10-12, 2014; pp. 1-10.
Alcantara, Ricardo et al.; "A Dynamic Characterization Approach for a Complex Naturally Fractured Reservoir" International Petroleum Technology Conference, Beijing, China, Mar. 26-28, 2019; pp. 1-40.
Aldrich, Jeffrey B. et al.; "'Sweet Spot' Identification and Optimization in Unconventional Reservoirs" Search and Discovery Article #80644 (2018); pp. 1-6.
ArcGIS Pro 2.8; "An overview of the Density toolset" available as of Apr. 4, 2022 at: https://pro.arcgis.com/en/pro-app/2.8/tool-reference/spatial-analyst/an-overview-of-the-density-tools.htm; p. 1.
ArcGIS Pro 2.8; "How Kernel Density Works" Available as of Mar. 14, 2022 at: https://pro.arcgis.com/en/pro-app/2.8/tool-reference/spatial-analyst/how-kernel-density-works.htm; pp. 1-6.
ArcGIS Pro 2.8; "Kernel Density (Spatial Analyst)" available as of Mar. 14, 2022 at: https://pro.arcgis.com/en/pro-app/2.8/tool-reference/spatial-analyst/kernel-density.htm; pp. 1-5.
ArcGIS Pro 2.8; "Line Density (Spatial Analyst)" available as of Apr. 4, 2022 at: https://pro.arcgis.com/en/pro-app/2.8/tool-reference/spatial-analyst/line-density.htm; pp. 1-6.
ArcGIS Pro 2.8; "Point Density (Spatial Analyst)" available as of Apr. 4, 2022 at: https://pro.arcgis.com/en/pro-app/2.8/tool-reference/spatial-analyst/point-density.htm; pp. 1-7.
ArcGIS; "How Kernel Density works" available as of Jan. 28, 2022 at: https://desktop.arcgis.com/en/arcmap/10.6/tools/spatial-analyst-toolbox/how-kernel-density-works.htm; pp. 1-3.
ArcGIS; "How Line Density works" available as of Jan. 18, 2022 at: https://desktop.arcgis.com/en/arcmap/10.6/tools/spatial-analyst-toolbox/how-line-density-works.htm; pp. 1-3.
Azari, Mehdi et al.; "Determining the Formation Properties with Innovative Formation Integrity Test Designed Using a Wireline Straddle Packer, A Field Example" SPWLA 59th Annual Logging Symposium, Jun. 2-6, 2018; pp. 1-12.
Barree, R.D. et al.; "Holistic Fracture Diagnostics" SPE 107877, Rocky Mountain Oil & Gas Technology Symposium, Denver, CO, Apr. 16-18, 2007; pp. 1-13.
Barton, Colleen A. et al.; "Fluid flow along potentially active faults in crystalline rock" Geology; Aug. 1995; v.23; No. 8; pp. 683-686.
Bisdom, Kevin et al.; "A geometrically based method for predicting stress-induced fracture aperture and flow in discrete fracture networks" AAPG Bulletin v. 100, No. 7 (Jul. 2016); pp. 1075-1097.
Bisdom, Kevin et al.; "The impact of in-situ stress and outcrop-based fracture geometry on hydraulic aperture and upscaled permeability in fractured reservoirs" (abstract only) Tectonphysics v. 690, Part A, Oct. 28, 2010; pp. 63-75.
Blakely, Richard J.; "Potential Theory in Gravity and Magnetic Applications" Cambridge University Press, 1996; pp. 1-9.
Camargo, Otto E. Meza et al.; "Reservoir Stress Path from 4D Coupled High Resolution Geomechanics Model: A Case Study for Jauf Formation, North Ghawar, Saudi Arabia" Saudi Aramco Journal of Technology, Fall 2016; pp. 45-59.
Cao, Yang-Bing et al.; "Calculation Method and Distribution Characteristics of Fracture Hydraulic Aperture from Field Experiments in Fractured Granite Area" (abstract only), Springer Ling, Nov. 9, 2015; pp. 1-18.
Cappa, F. et al.; "Estimation of fracture flow parameters through numerical analysis of hydromechanical pressure pulses" Water Resources Research, American Geophysical Union, 2008, 44, pp. W11408; pp. 1-49.
Chen, Sheng et al.; "Prediction of sweet spots in shale reservoir based on geophysical well logging and 3D seismic data" Energy Exploration & Exploitation, vol. 35(2), 2017; pp. 147-171.
Engelder, Terry et al.; "Chapter 15: A Pore-Pressure Limit in Overpressured South Texas Oil and Gas Fields" pp. 255-267, AAPG Memoir 67, 1997; pp. 255-267.
Ferreira, Francisco J.F. et al.; "Enhancement of the total horizontal gradient of magnetic anomalies using the tilt angle" Geophysics vol. 78, No. 3 (May-Jun. 2013); pgs. J33-J41.
Fischer, K. et al.; "A workflow for building and calibrating 3-D geomechoanical models—a case study for a gas reservoir in the North German Basin" Solid Earth, 4, (2013); pp. 347-355.
Fischer, K. et al.; "Generating and Calibrating 3D Geomechanical Reservoir Models" 75th EAGE Conference and Exhibition incorporating SPE EUROPEC 2013, London UK, Jun. 10-13, 2013; pp. 1-5.
Friedman, Jerome H.; "Greedy Function Approximation: A Gradient Boosting Machine" 1999 Reitz Lecture, The Annals of Statistics (2001), vol. 29, No. 5; pp. 1189-1232.
Gan, Quan et al.; "A continuum model for coupled stress and fluid flow in discrete fracture networks" Geomech. Geophys. Geo-energ. Geo-resour. (2016); pp. 2:43-61.
Ge, Jun et al.; "Semianalytical modeling on 3D stress redistribution during hydraulic fracturing stimulation and its effects on natural fracture reactivation" Int J Numer Anal Methods Geomech. (2020) / V. 44, / 8; pp. 1184-1199.
Gray, F. David et al.; "Fracture detection in the Manderson Field: A 3D Avaz case history" Society of Exploration Geophysicists, Jan. 5, 2005; pp. 1-4.
Gunn, P. J.; "Linear Transformations of Gravity and Magnetic Fields" Geophysical Prospecting vol. 23, Issue 2, Jun. 1974; pp. 300-312.
Han, Jiahang et al.; "Stress Field Change Due to Reservoir Depletion and Its Impact on Refrac Treatment Design and SRV in Unconventional Reservoirs" SPE-178496-MS/URTeC:2144941; Unconventional Resources Tech. Conf., Texas, Jul. 20-22, 2015; pp. 1-11.
Herwanger, J.; "Seismic Geomechanics, How to Build and Calibrate Geomechanical Models using 3D and 4D Seismic Data" 1 Edn., EAGE Publications b.v. Houten, 2011; pp. 1-219 (in 3 parts).
Huang, Jian et al.; "Natural-hydraulic fracture interaction: Microseismic observations and geomechanical predictions" (abstract only) Interpretation (2015) 3 (3); pp. SU17-SU31.
International Search Report and Written Opinion for International Application No. PCT/US2018/046824 (SA5707) report mail date Nov. 28, 2018; pp. 1-13.
International Search Report and Written Opinion for International Application No. PCT/US2020/062069 (SA51044), report mail date Mar. 11, 2021; pp. 1-18.
International Search Report and Written Opinion for International Application No. PCT/US2021/018379 (SA51284) report mail date May 28, 2021; pp. 1-16.
Jacquemyn, Carl et al.; "Mechanical stratigraphy and (paleo-) karstification of the Murge area (Apulia, southern Italy)" Geological Society, London, Special Publications 2012, vol. 370; pp. 169-186.
U.S. Appl. No. 17/721,064 (SA51697) titled "Identifying Naturally Fractured Sweet Spots Using a Fracture Density Index (FDI)" filed Apr. 14, 2022.

(56) References Cited

OTHER PUBLICATIONS

Van Lanen, Xavier et al.; "Integrated geologic and geophysical studies of North American continental intraplate seismicity" The Geological Society of America, Special Paper 425, 2007; pp. 101-112.
Wikipedia; "Kernel density estimation" available as of Apr. 4, 2022 at: https://en.wikipedia.org/wiki/Kernel_density_estimation#:~: text= In statistics%2C kernel density estimation, on a finite data sample; pp. 1-12.
Wilson, Adam; "Common Mistakes Associated with Diagnostic Fracture Injection Tests" Journal of Petroleum Technology, Aug. 31, 2014; pp. 1-6.
Worden, R.H. et al.; "Gas Souring by Thermochemical Sulfate Reduction by 140C1" The American Association of Petroleum Geologists Bulletin, V. 79, No. 6 (Jun. 1995); pp. 854-863.
Worden, Richard H. et al.; "Origin of H2S in Khuff Reservoirs by Thermochanical Sulfate Reduction: Evidence from Fluid Inclusions" Saudi Aramco Journal of Technology, Fall 2004; pp. 42-52.
Wynants-Morel, Nicolas et al.; "Stress Perturbation From Aseismic Slip Drives the Seismic Front During Fluid Injection in a Permeable Fault" JGR Solid Earth vol. 125, Issue 7, Jul. 2020; pp. 1-23.
XGBoost Tutorials; "Introduction to Boosted Trees" available as of Aug. 3, 2023 at: https://xgboost.readthedocs.io/en/stable/tutorials/model.html; pp. 1-10.
Zellou, Abdel et al.; "Fractured Reservoir Characterization Using Post-Stack Seismic Attributes: Application to a Hungarian Reservoir", EAGE 68th Conference & Exhibition—Vienna, Austria, Jun. 12-15, 2006; pp. 1-4.
Zeng, Qingdong et al.; "Numerical Simulation of Fluid-Solid Coupling in Fractured Porous Media with Discrete Fracture Model and Extended Finite Element Method" Computation (2015), 3; pp. 541-557.
Zhu, GuangYou et al.; "The controlling factors and distribution prediction of H2S formation in marine carbonate gas reservoir, China" (abstract only) Chinese Science Bulletin, vol. 52 (2007), pp. 150-163.
Zoback, Mark D .; "Critically stressed faults and fluid flow" Reservoir Geomechanics Chapter 11, Cambridge University Press, New York, 2007, pp. 1-21.

* cited by examiner

FRACTURE REACTIVATION INDEX (FRI) FOR SEAL INTEGRITY ANALYSIS IN CARBON CAPTURE AND STORAGE (CCS)

BACKGROUND

Field of the Disclosure

The present disclosure generally relates to fluid injection in subsurface wells. More specifically, embodiments of the disclosure relate to analysis of caprock integrity using a fracture reactivation index (FRI).

Description of the Related Art

Fluid injection into fluid reservoirs via subsurface wells may be used in a number of applications. For example, fluid injection may be used in waterflooding operations, enhanced oil recovery (EOR) carbon capture and storage (CCS), steam injection operations, or other operations. In such fluid injection operations, the integrity of the boundary layer (or "seal") around a fluid reservoir is an important factor in the success of the operations. This boundary layer is typically formed of relatively impermeable rock surrounding the reservoir that is referred as "caprock."

SUMMARY

Caprock integrity is an important factor in successful fluid injection operations, and particularly carbon capture and storage (CCS). In CCS operations, carbon dioxide ($CO_2$) is may be injected into a naturally fractured reservoir for storage. However, it may be difficult to determine the risk of natural fracture reactivation due to fluid injections and storage.

Embodiments of the disclosure generally relate to evaluating caprock integrity in naturally fractured reservoirs using a fracture reactivation index (FRI). The fracture reactivation index (FRI) may identify the risk of natural fracture reactivation in response to changes in the in-situ stress state or relatively high pressure areas due to the fluid injection such as $CO_2$ injection. The fracture reactivation index (FRI) may also identify "sweet spots" of natural fractures in a reservoir. Embodiments of the disclosure further include a mechanical earth model to quantify the minimum principal in-situ stress in the caprock to determine the injection pressure limits and safeguard against undesired breakthrough into adjacent zones.

Advantageously, embodiments of the disclosure enable the identification of areas that are more potentially sensitive to fracture reactivations which result in a leaking seal, thus aiding in the identification of sufficient caprock integrity for use in CCS injections and storage development.

In one embodiment, a method for determining caprock integrity in a subsurface reservoir using a fracture reactivation index (FRI) is provided. The method includes determining a principal stress associated with subsurface reservoir, the principal stress determined by a micro-fracturing test and forming, using a mechanical earth model, a fracture network model to identify the presence and extent of natural fractures at locations in the subsurface hydrocarbon reservoir, such that the mechanical earth model incorporates the principal stress. The method also includes determining, using the discrete fracture network, a fracture density index (FDI), such that determining the fracture density index (FDI) includes generating a raster map from the discrete fracture network, the raster map representing a fracture density per area, and determining Coulomb Excessive Failure Function (CEFF) values for natural fractures in the discrete fracture network, the CEFF values determined using a shear stress, a normal stress, a friction angle, a vertical stress. Additionally, the method includes determining a fracture reactivation index (FRI) using the CEFF values, such that a subset of CEFF values above a threshold identify a subset of natural fractures having a potential for reactivation due to a failure of caprock integrity.

In some embodiments, the Coulomb Excessive Failure Function (CEFF) is $CEFF=(\tau-\sigma_n*\mathrm{Tan}(\varphi))/S_v$, where $\tau$ is the shear stress, $\sigma_n$ is the normal stress, $\varphi$ is the friction angle, and $S_v$ is the vertical stress. In some embodiments, the method includes performing the micro-fracturing test. In some embodiments, the method includes identifying an area for fluid injection using a map comprising the fracture reactivation index (FRI). In some embodiments, the method includes performing a fluid injection into the subsurface reservoir based on the identified area. In some embodiments, the fluid is carbon dioxide ($CO_2$). In some embodiments, determining the principal stress associated with subsurface reservoir includes determining a fracture closure pressure using the micro-fracturing test.

In another embodiment, a non-transitory computer-readable storage medium having executable code stored thereon for determining caprock integrity in a subsurface reservoir using a fracture reactivation index (FRI) is provided. The executable code has a set of instructions that causes a processor to perform operations that include determining a principal stress associated with subsurface reservoir, the principal stress determined by a micro-fracturing test and forming, using a mechanical earth model, a fracture network model to identify the presence and extent of natural fractures at locations in the subsurface hydrocarbon reservoir, such that the mechanical earth model incorporates the principal stress. The operations also include determining, using the discrete fracture network, a fracture density index (FDI), such that determining the fracture density index (FDI) includes generating a raster map from the discrete fracture network, the raster map representing a fracture density per area, and determining Coulomb Excessive Failure Function (CEFF) values for natural fractures in the discrete fracture network, the CEFF values determined using a shear stress, a normal stress, a friction angle, a vertical stress. Additionally, the operations include determining a fracture reactivation index (FRI) using the CEFF values, such that a subset of CEFF values above a threshold identify a subset of natural fractures having a potential for reactivation due to a failure of caprock integrity.

In some embodiments, the Coulomb Excessive Failure Function (CEFF) is $CEFF=(\tau-\sigma_n*\mathrm{Tan}(\varphi))/S_v$, where $\tau$ is the shear stress, $\sigma_n$ is the normal stress, $\varphi$ is the friction angle, and $S_v$ is the vertical stress. In some embodiments, the operations include identifying an area for fluid injection using a map comprising the fracture reactivation index (FRI). In some embodiments, the operations include controlling a fluid injection into the subsurface reservoir based on the identified area. In some embodiments, the fluid is carbon dioxide ($CO_2$). In some embodiments, determining the principal stress associated with subsurface reservoir includes determining a fracture closure pressure using the micro-fracturing test.

In another embodiment, a system for determining caprock integrity in a subsurface reservoir using a fracture reactivation index (FRI) is provided. The system includes a processor and a non-transitory computer-readable memory accessible by the processor and having executable code stored thereon. The executable code has a set of instructions that causes a processor to perform operations that include determining a principal stress associated with subsurface reservoir, the principal stress determined by a micro-fracturing test and forming, using a mechanical earth model, a fracture network model to identify the presence and extent of natural fractures at locations in the subsurface hydrocarbon reservoir, such that the mechanical earth model incorporates the principal stress. The operations also include determining, using the discrete fracture network, a fracture density index (FDI), such that determining the fracture density index (FDI) includes generating a raster map from the discrete fracture network, the raster map representing a fracture density per area, and determining Coulomb Excessive Failure Function (CEFF) values for natural fractures in the discrete fracture network, the CEFF values determined using a shear stress, a normal stress, a friction angle, a vertical stress. Additionally, the operations include determining a fracture reactivation index (FRI) using the CEFF values, such that a subset of CEFF values above a threshold identify a subset of natural fractures having a potential for reactivation due to a failure of caprock integrity.

In some embodiments, the Coulomb Excessive Failure Function (CEFF) is $CEFF=(\tau-\sigma_n*\mathrm{Tan}(\varphi))/S_v$, where $\tau$ is the shear stress, $\sigma_n$ is the normal stress, $\varphi$ is the friction angle, and $S_v$ is the vertical stress. In some embodiments, the operations include performing the micro-fracturing test. In some embodiments, the operations include identifying an area for fluid injection using a map comprising the fracture reactivation index (FRI). In some embodiments, the operations include controlling a fluid injection into the subsurface reservoir based on the identified area. In some embodiments, the fluid is carbon dioxide ($CO_2$). In some embodiments, determining the principal stress associated with subsurface reservoir includes determining a fracture closure pressure using the micro-fracturing test.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

The present disclosure will be described more fully with reference to the accompanying drawings, which illustrate embodiments of the disclosure. This disclosure may, however, be embodied in many different forms and should not be construed as limited to the illustrated embodiments. Rather, these embodiments are provided so that this disclosure will be thorough and complete, and will fully convey the scope of the disclosure to those skilled in the art.

Embodiments of the disclosure are directed to systems, methods, and computer-readable for determining caprock integrity via a fracture reactivation index (FRI). As used herein, the term "caprock integrity" also refers to the "seal integrity." A mechanical earth model is determined to quantify the minimum principal in-situ stress in the caprock to determine the injection pressure limits and safeguard against undesired breakthrough into adjacent zones. A fracture model is generated using the mechanical earth model, and a critical stress analysis may be performed. After determination of a fracture density index and Coulomb Excessive Failure Function (CEFF), the fracture reactivation index (FRI) is determined. The fracture reactivation index (FRI) may identify the risk of natural fracture reactivation in response to changes in the in-situ stress state or relatively high pressure areas due to the fluid injection such as $CO_2$ injection.

The estimated minimum in-situ stress in the caprock may determine the injection pressure limits that safeguard against undesired breakthrough into adjacent zones. A determination of reservoir mechanical behavior under change of in-situ stress state between depleted and non-depleted reservoir layers may assist in quantifying the stress contrast in the multiple intervals with different reservoir pressure regimes. In unconventional reservoirs having extremely low permeability, relatively large vertical and lateral heterogeneity, and complex geological settings, the in-situ rock stress envelope may be challenging to define. Formation breakdown, fracture reopening, and fracture propagation and closure at multiple reservoir layers may provide in-situ measurements that enable the calibration of change in stress due to pore pressure depletion. The formation and seal integrity, as well as the minimum principal stress in the formation, are often required in deciding whether to complete these wells. The stress magnitudes are typically derived from models that are calibrated to available direct or indirect field measurements. The accuracy of these models relies heavily on proper tectonic strain and stress calibration using micro-fracture testing conducted in vertical pilot wellbores. Well-injection plans, caprock integrity assessment, stress contrast, shale reservoir fracture containment, hydraulic fracture containment, and minimum and maximum horizontal stress estimations may be quantified from multiple micro-fracture tests recorded at various depths of the reservoir formation.

Figure 1:
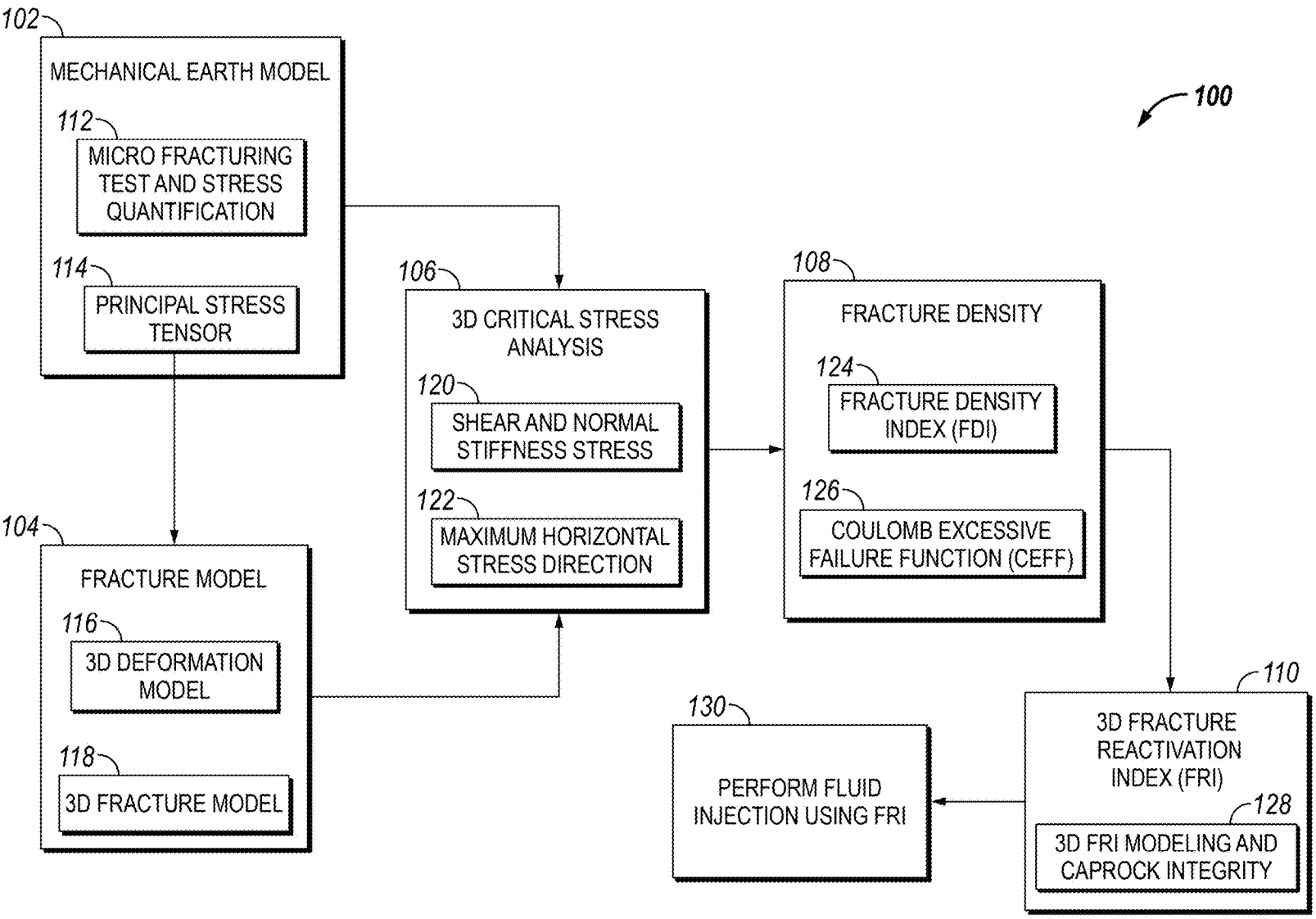
FIG. 1 is a block diagram of a process for determining caprock integrity via a fracture reactivation index (FRI) in accordance with an embodiment of the disclosure.

FIG. 1 depicts a process 100 for determining caprock integrity via a fracture reactivation index (FRI) in accordance with an embodiment of the disclosure. A shown in FIG. 1, the process includes determining a mechanical earth model (block 102), determining a 3D fracture model (block 104), performing a 3D critical stress analysis (block 106), determining a fracture density index (FDI) (block 108), and determining a 3D fracture reactivation index (block 110).

The process 100 may initially include determining a mechanical earth model (block 102), such as a 1D/3D mechanical earth model. In some embodiments, the mechanical earth model may be implemented according to the techniques described in U.S. Pat. No. 11,098,582, issued Aug. 24, 2021, and titled "DETERMINATION OF CALIBRATED MINIMUM HORIZONTAL STRESS MAGNITUDE USING FRACTURE CLOSURE PRESSURE AND MULTIPLE MECHANICAL EARTH MODEL REALIZATIONS," now issued U.S. Pat. No. 11,098,582, a copy of which is incorporated by reference in its entirety.

Determination of the 1D/3D mechanical earth model may include performing a micro-fracture test and stress quantification (block 112). The microfracture test may measure the fracture initiation, propagation, reopening, and closure pressure at various intervals of a reservoir to validate and calibrate the horizontal stress profile, which may assist in stress-field anisotropy, the impact of the stress-field on productivity, and caprock integrity.

Figure 2:
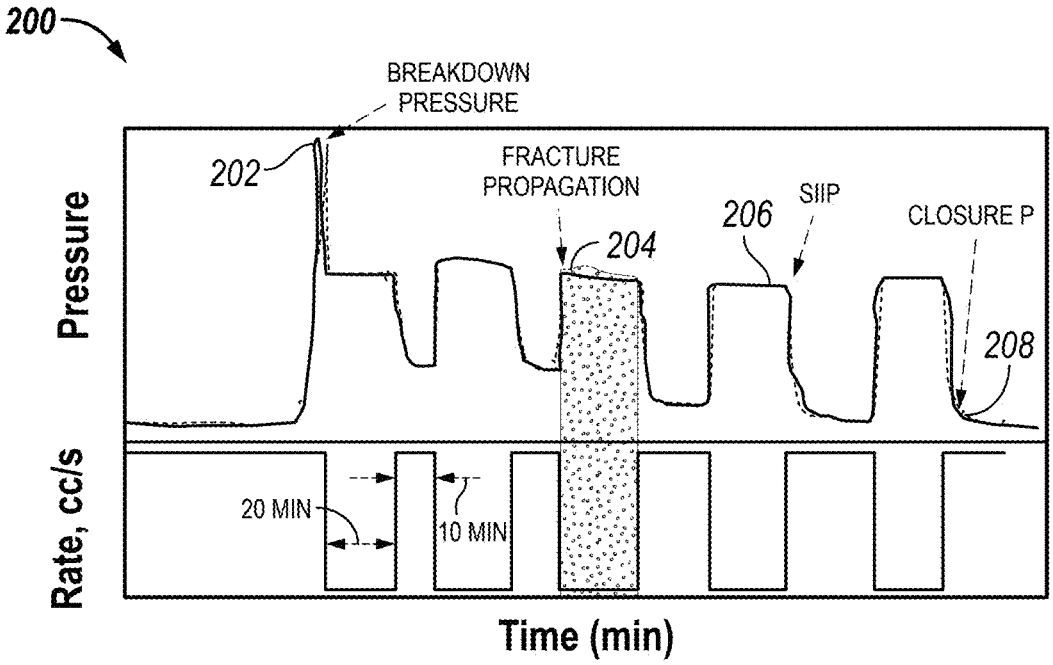
FIG. 2 is a graph of microfracture pressure and injection rate vs time for an example five-cycle microfracture test conducted with a straddle packer wireline formation tester (WFT) in accordance with an embodiment of the disclosure.

By way of example, FIG. 2 depicts a graph 200 of microfracture pressure and injection rate (in cubic centimeters per second (cc/s)) (both on the y-axis) vs time (in minutes) (on the y-axis) for an example five-cycle microfracture test conducted with a straddle packer wireline formation tester (WFT) in accordance with an embodiment of the disclosure. As shown in the graph of the injection rate vs time, the injection rate includes injections of 10 minutes spaced at 20 minute intervals.

The first data point retrieved during a microfracture test is the formation breakdown pressure. The formation breakdown is characterized by a pressure "spike" during the initial pressurization of the formation, as shown at point 202 in FIG. 2. Because a crack tip may have been initiated during the perforation operation, breakdown data from a cased hole test may be considered invalid.

FIG. 2 also depicts a fracture opening pressure (FOP) or fracture propagation pressure, shown at point 204. The fracture propagation pressure is the pressure at which an existing fracture may be reopened. This pressure may be characterized by a decrease from the constant pressure increase rate during the early time period of a microfracture test cycle. Although it is not as consistent as shut-in or flow back data, this pressure may be used as a value for the least principal stress.

As also shown in FIG. 2, instantaneous shut-in pressure (ISIP) is shown at point 206. Instantaneous shut-in pressure (ISIP) may also be referred to as the least principal stress. ISIP may be used as the least principal stress in those instances where fluid loss is very high and the fracture closes quickly. The difference between the last pumping pressure and the ISIP is the frictional pressure drop from the tip of the fracture to the pressure.

Figure 3:
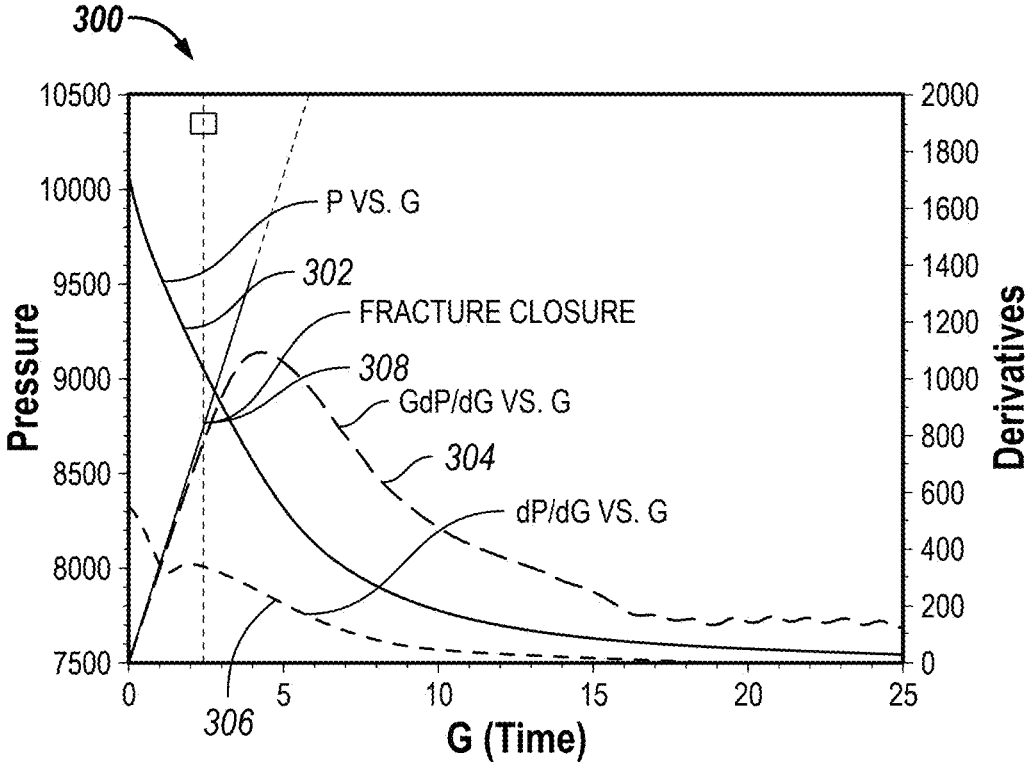
FIG. 3 depicts a plot of pressure vs G (dimensionless time) and illustrates a G-function for normal leak-off in accordance with an embodiment of the disclosure.

FIG. 2 also depicts fracture closing pressure (FCP) at point 208. Fracture closure pressure (FCP) may define the minimum in-situ stress. The pressure decline from a micro-fracture test may be analyzed in two main phases; i) before closure (BC) and ii) after closure (AC) of the created fracture. In some embodiments, the FCP may additionally or alternatively be determined from analysis of the shut-in pressure decline before closure using a "G-function" and various other plots. As referred to herein, the G-function is a pressure-dimensionless time function designed to linearize the pressure behavior during normal fluid leak-off from a hydraulic micro-fracturing treatment. FIG. 3 depicts a plot 300 of pressure vs G (dimensionless time) and illustrates a G-function 302 for normal leak-off in accordance with an embodiment of the disclosure. The plot 300 also includes a derivative (dP/dG vs. G) graph 304 and a G*dP/dG vs. G graph 306 as is known the art. Point 308 corresponding to a fracture closure is also shown.

For the linear flow before fracture closure and for normal leak-off, a straight-line trend of the G-function derivative 304 may be expected with a continuous increase of the derivative slope value. The point at which the G-function derivative 304 begins to deviate downward from the linear trend may be identified as the point where the fracture closes-fracture closing pressure. The fracture closing pressure may also be determined from the one-half slope transition to a flat line. It should be appreciated that a large wellbore storage volume may mask the one-half slope section of the G-function data when applying the micro-fracturing test from the surface; however, a WFT has a very small wellbore storage and volume and may reduce or avoid this masking.

Consistent fracture closure time and stress, and the identification of transient flow regimes, may be determined with the assistance of supplementary plots of square root of shut-in time and the log-log plot of pressure changes (and their derivatives). As will be appreciated, microfracture tests usually show little evidence of fracture or bilinear flow in the shut-in tests. In some embodiments, the transient flow regime may be identified in order to perform an After-Closure Analysis (ACA). In some embodiments, if a pseudo-radial flow regime is identified, then a Cartesian Radial Flow plot or a conventional Horner plot can be used to determine far-field reservoir transmissibility (expressed as $kh/\mu$, where the viscosity, $\mu$ is the far-field fluid viscosity, h is the estimated net pay height, and k is the effective reservoir permeability).

Figure 4:
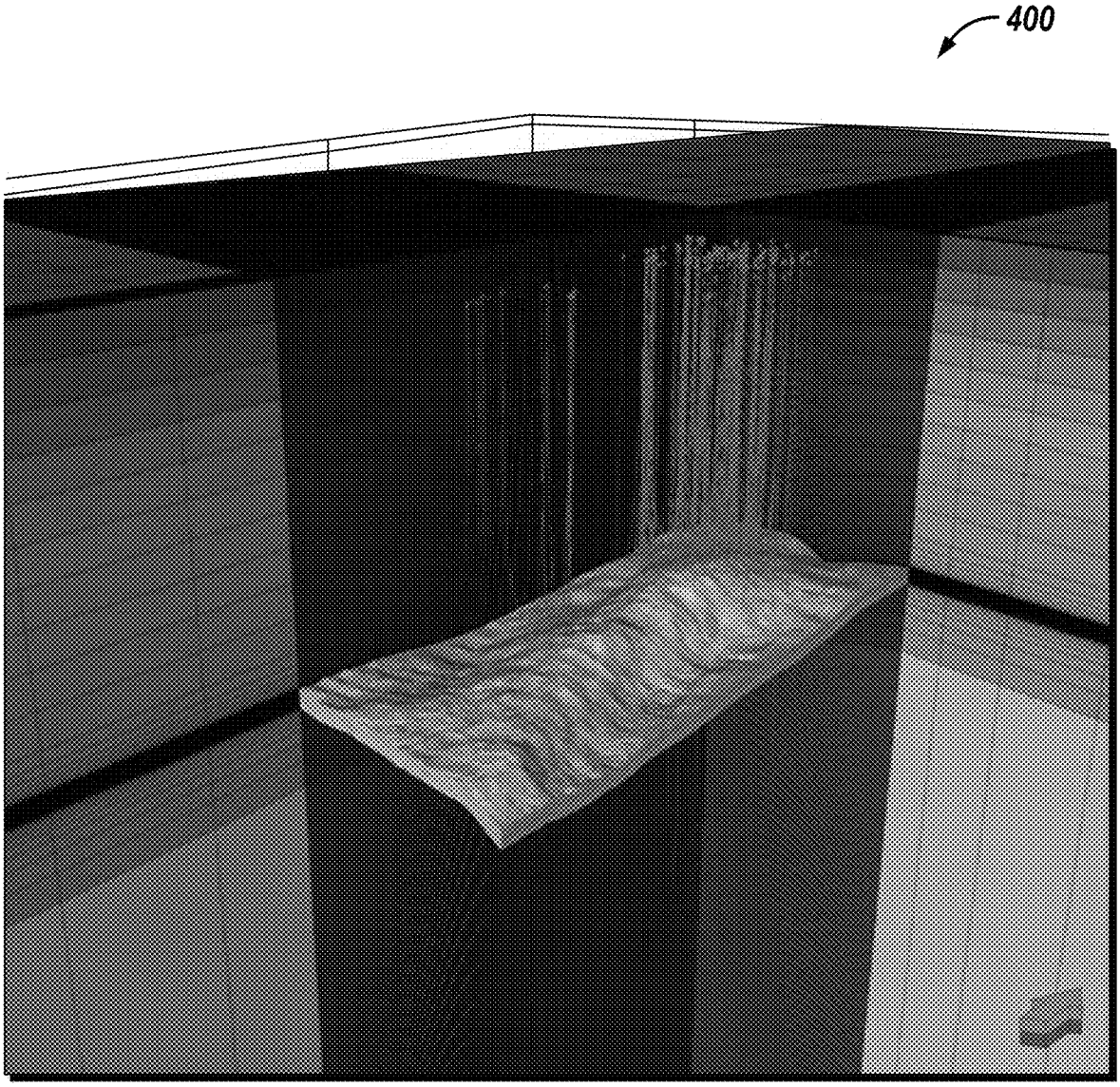
FIG. 4 depicts the gridding of a 3D mechanical earth model in accordance with an embodiment of the disclosure.

As shown in FIG. 1, determining the mechanical earth model (block 102) may also include determining a principal stress tensor (block 114). The in-situ stress regime may be modeled to capture the features for the mechanical properties, such as brittleness, geomechanical facies, and in-situ stress rotations and stress magnitude variation along the field. After modeling, a finite element geomechanical simulation may be performed to construct a 3D mechanical earth model. In some embodiments, the 3D mechanical earth model may be constructed using geomechanical simulation software such as VISAGE™ manufactured by Schlumberger Limited of Houston, Texas, USA. By way of example, FIG. 4 depicts the gridding of a 3D mechanical earth model 400 in accordance with an embodiment of the disclosure.

Figure 5:
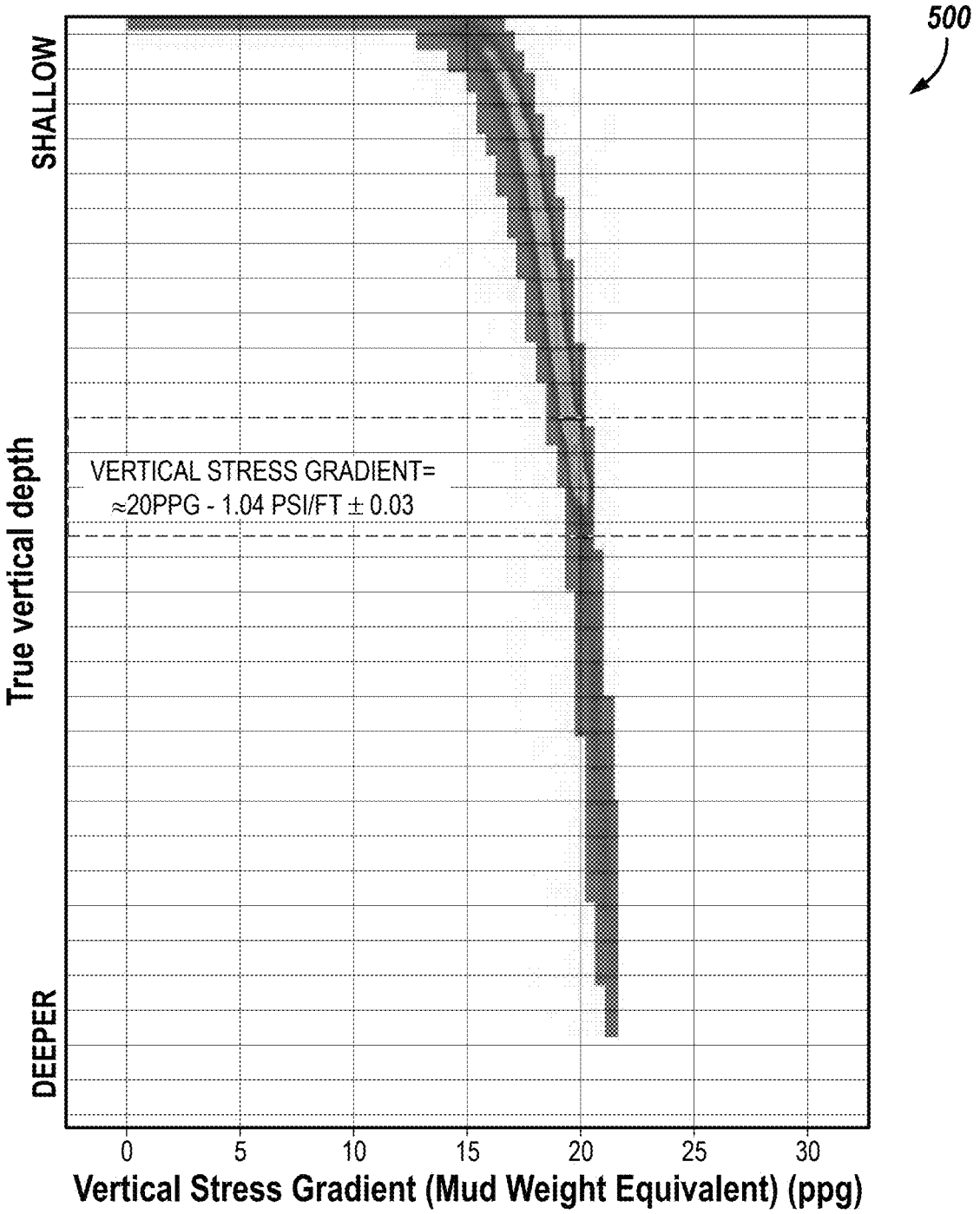
FIG. 5 is a plot of true vertical depth vs. vertical stress gradient that shows a vertical stress calculation using a compaction line and bulk density in accordance with an embodiment of the disclosure.

As a part of this determination, the vertical (also referred to as "overburden") stress may be determined using bulk density logs and a compaction lines technique. By way of example, FIG. 5 depicts a plot 500 of true vertical depth vs. vertical stress gradient (in mud weight equivalent of pounds per gallon (ppg)) that shows a vertical stress calculation using a compaction line and bulk density in accordance with an embodiment of the disclosure. As shown in the example depicted in FIG. 5, the vertical stress gradient is approximately 1.04 pounds per square inch (psi) per foot (ft). As discussed supra, the minimum stress values may be estimated from a micro-fracturing test for determining the fracture closure pressure (FCP); for the example shown in FIG. 5, the minimum stress was calculated to be about 0.78 psi/ft.

Figure 6:
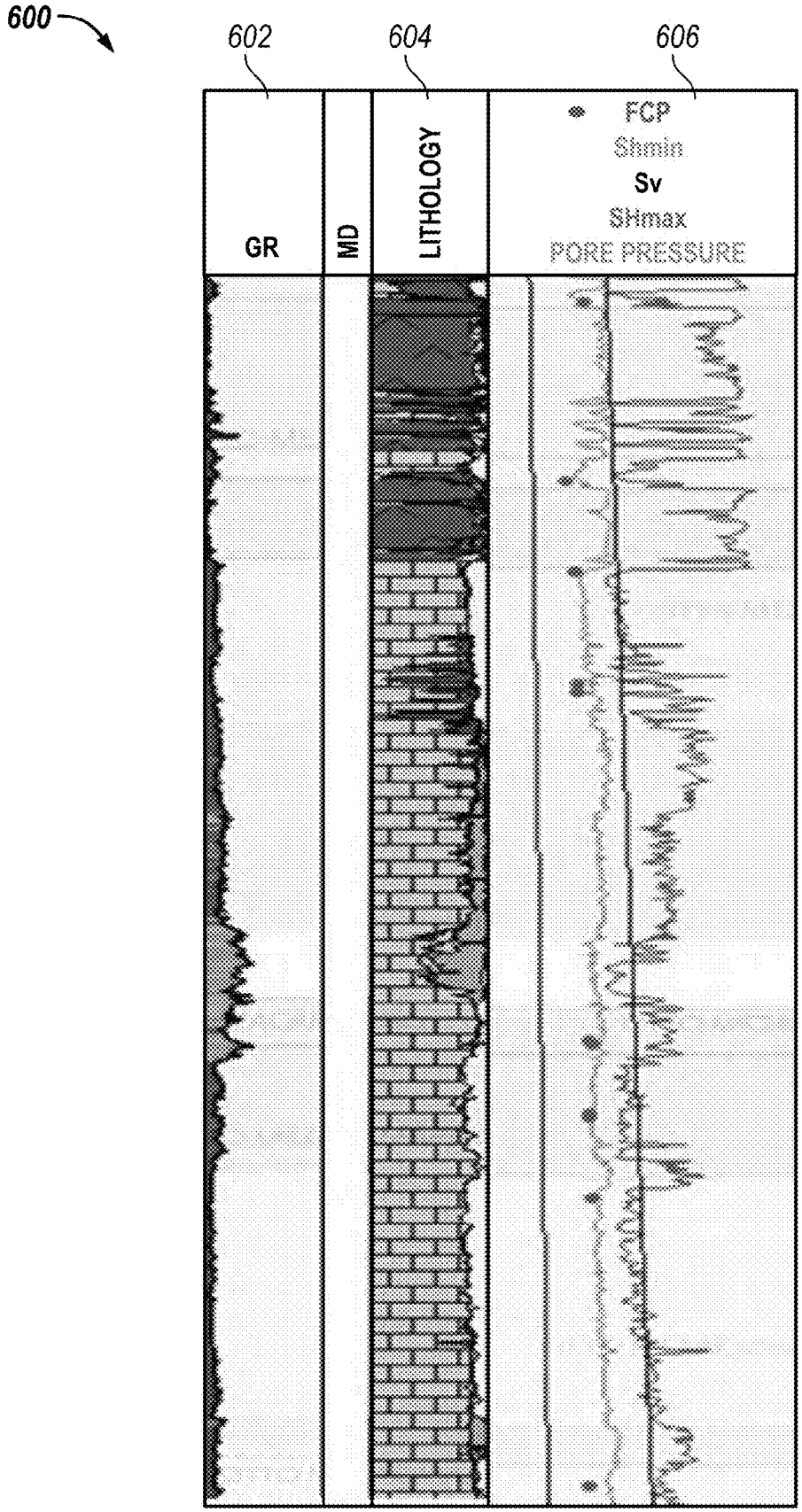
FIG. 6 is a composite log showing gamma ray (Gr) measurements, lithology, and fracture closure pressure, minimum horizontal stress ($S_{hmin}$), vertical stress ($S_v$), maximum horizontal stress ($S_{hmax}$), and pore pressure, in accordance with an embodiment of the disclosure.

The minimum horizontal stress ($S_{hmin}$) may be calculated from the fracture closure pressure. By way of example, FIG. 6 depicts a composite log 600 showing gamma ray (Gr) measurements (602), lithology (604), and fracture closure pressure, minimum horizontal stress ($S_{hmin}$), vertical stress ($S_v$), maximum horizontal stress ($S_{hmax}$), and pore pressure (606), in accordance with an embodiment of the disclosure. FIG. 6 depicts a consistent trend for the fracture closure pressure across the example well.

The maximum horizontal stress ($S_{Hmax}$) may be determined by assuming a strike-slip fault regime such that the maximum horizontal stress ($S_{Hmax}$) is the largest principal stress (that is, $S_{Hmax}>S_v>S_{hmin}$). The orientation of the maximum horizontal stress may be determined using wellbore failure analysis such as borehole breakouts and drilling-induced tensile fractures interpreted from a borehole image (BHI) log.

A minimum horizontal stress ($S_{hmin}$) and maximum horizontal stress ($S_{Hmax}$) profile may be determine using a poro-elastic and horizontal-strain stress approach, such that the minimum horizontal stresses and maximum horizontal stresses at each depth depend on the following factors: 1) mechanical properties; 2) pore pressure; and 3) vertical stress (overburden). The pore pressure may be determined from direct measurements using MDT (Modular Formation Dynamics) and Bottom Hole Static Pressure (BHSP) as known in the art. The maximum horizontal stress ($S_{Hmax}$) may also be constrained by using wellbore stability model and drilling events (for example, mud lost circulation, stuck pipes, in-flow, and tight hole).

As shown in FIG. 1, the process 100 may including determining a 3D fracture model (block 116). The 3D fracture model may include a Discrete Fracture Network (DFN) spatial distribution primarily constrained by geomechanical and tectonic drivers. The fracture parameters used to construct the network may be length, orientation, aspect ratio (length/height), aperture, and fracture permeability.

Determining a 3D fracture model 3D fracture model may include determination of a 3D deformation model (block 108). The 3D deformation model may be generated by performing a geomechanics numerical simulation using finite elements methods to capture the main episodes for paleo-stress tectonic deformation that could create most of the fractures observed at well level. These fractures may be modeled primarily with two processes: 1) folding fracture related and 2) faulting fracture related.

As shown in FIG. 1, the 3D fracture model may be constructed (block 118). The 3D fracture model may be constructed according to the techniques described in U.S. Patent No. 10,607,043, issued Mar. 31, 2020, and titled "SUBSURFACE RESERVOIR MODEL WITH 3D NATURAL FRACTURES PREDICTION," a copy of which is incorporated by reference in its entirety.

As shown in FIG. 1, the process 100 may include a 3D critical stress analysis (block 106). The main fluid flow pathways may be discriminated from the 3D discrete fracture network (DFN) resulting from geomechanics and natural fracture prediction (NFP) modeling. The critically stressed fractures and fracture apertures estimation may be performed according to the techniques described in U.S. Publication No. 2023/0084141 A1, published Mar. 16, 2023, and titled "IDENTIFYING FLUID FLOW PATHS IN NATURALLY FRACTURED RESERVOIRS," a copy of which is incorporated by reference in its entirety.

From the different fracture sets existing within the reservoir, only certain fractures will be optimally oriented under "in situ stress" for shearing and reactivation, and, thus, are hydraulically more conductive. Fracture aperture computed using a microresistivity method confirms that fractures closer to failure by shear stress exhibit larger apertures and therefore, they are expected to have higher permeability. A discretized 3D fracture network may thus be produced that only contains fractures representing main fluid pathways in the reservoir.

The 3D critical stress analysis may include use of shear and normal stiffness stress for critically stressed fractures and fracture apertures determination (block 120). In terms of stress tensor components $\sigma_{i,j}$ the normal stress may be defined as the product of stress vector multiplied by normal unit vector $\sigma_n=T^{(n)}\cdot n$ and the magnitude of the shear stress ($\tau_n$) component as defined in Equation 1:

$$\tau_n=\sqrt{(T^{(n)})^2-\sigma_n} \tag{1}$$

A fluid flow path (that is, a critically stressed fracture) may be determined from shear stress and normal effective stress as shown in Equation 2:

$$\text{Fluid flow path}=(\tau-\sigma_n*\text{Tan}(\varphi))\geq 0 \tag{2}$$

In some embodiments, fluid flow paths for a fracture network in a rock matrix may be identified by using determined apertures combined with the normal effective stress and shear stress. The largest aperture corresponds to the greatest distance between the points and the failure Mohr Coulomb line (that is, the friction angle for non-intact rock). In some embodiments, apertures may be determined from microresistivity logs calibrated microresistivity arrays, the fracture dataset, shallow resistivity, and drilling mud resistivity. The fracture aperture determination may be performed using Equation 3:

$$W=cAR_m^{\ b}{}_{xo}R^{1-b} \tag{3}$$

where W is the fracture width (that is, aperture), $R_{xo}$ is the flushed zone resistivity, $R_m$ is the mud resistivity, and A is the excess current flowing into the rock matrix through the conductive media due to the presence of the fracture. The excess current is a function of the fracture width and may be determined from statistical and geometrical analysis of the anomaly it creates as compared to background conductivity. For example, the excess current may be determined by dividing by voltage and integrating along a line perpendicular to the fracture trace. The term c is a constant and b is numerically obtained tool-specific parameter (that is, specific to the resistivity tools). As will be appreciated, a greater fracture aperture (W) indicates a more open fracture that is likely to flow hydrocarbons or other fluids, and a lesser fracture aperture indicates a fracture that will likely have reduced or low flow to hydrocarbons or other fluids.

Figure 7A:
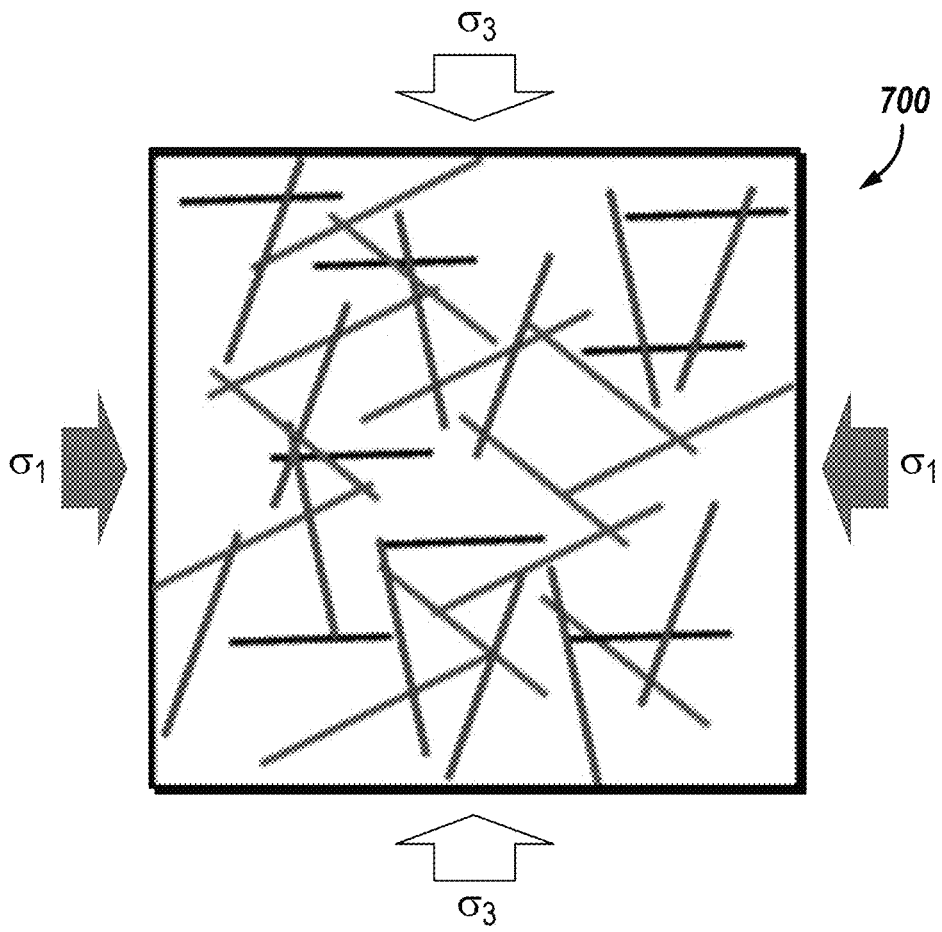
FIG. 7A is a diagram illustrating fluid flow paths for hydraulically conductive and non-hydraulically conductive fractures using normal stresses ($\sigma_1$ and $\sigma_3$) in accordance with an embodiment of the disclosure.
Figure 7B:
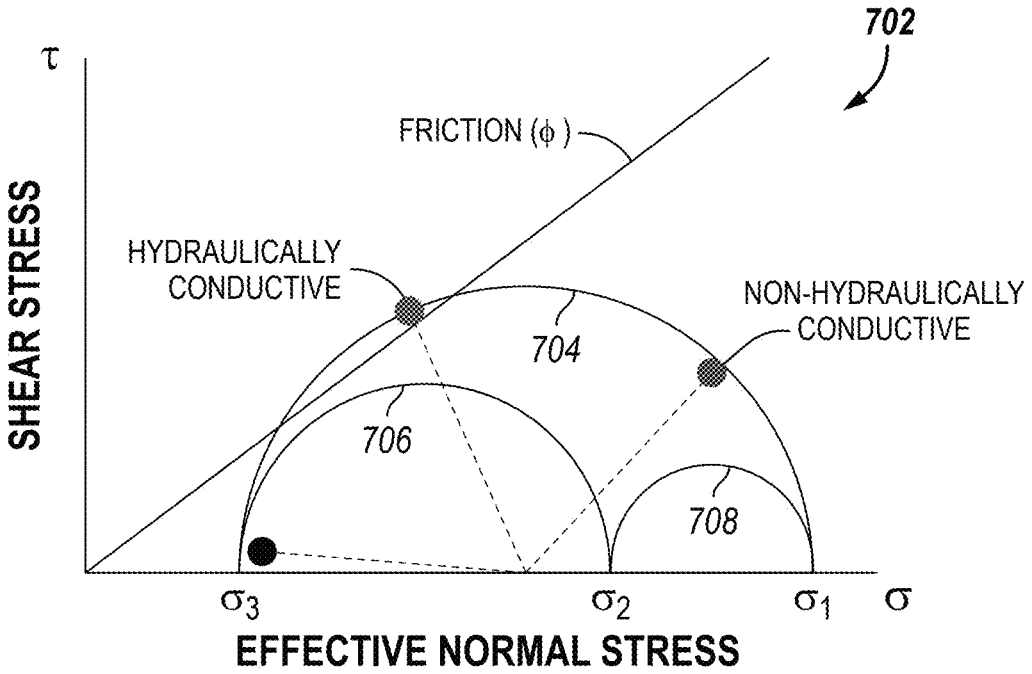
FIG. 7B is a plot of shear stress vs normal stress and coefficient of friction in accordance with an embodiment of the disclosure.

Critical stress depends on the stress magnitude and the orientation of the fracture plane with respect to the in-situ stress orientation. The stress orientation affects the normal and shear stresses acting in the fracture plane. When normal and shear stress exceed the friction angle (for non-intact rock), the shearing may produce dilation that keeps the fracture hydraulically open. Fractures in this state may be referred to as "reactivated," "critically stressed," or as a "fluid flow path." FIG. 7A is a diagram 700 illustrating fluid flow paths for hydraulically conductive and non-hydraulically conductive fractures using normal stresses ($\sigma_1$ and $\sigma_3$) in accordance with an embodiment of the disclosure. FIG. 7B is a plot 702 of shear stress vs normal stress and coefficient of friction in accordance with an embodiment of the disclosure. FIG. 7B illustrates "Mohr circles" 704, 706, and 708, as is known in the art.

Shear failure may be caused by two perpendicular stresses acting on the same plane, and is defined in conjunction with a Mohr circle by the following equation expressing stress conditions shown schematically in FIG. 7B:

$$\sigma 1' \geq C0 + \sigma 3' \tan 2\beta \tag{4}$$

Where C0 is the unconfined compressive strength, $\sigma 1'$ is the maximum effective stress, $\sigma 3'$ is the minimum effective stress, and $\beta$ is the angle between the normal stress and the maximum effective stress $\sigma 1'$, such is $\beta$ is determined as follows:

$$\beta = 45° + \frac{\phi}{2} \tag{5}$$

Where $\phi$ is the friction angle.

If the maximum effective stress $\sigma 1'$ is exceeded, then the conditions for shear failure are satisfied.

Figure 8B:
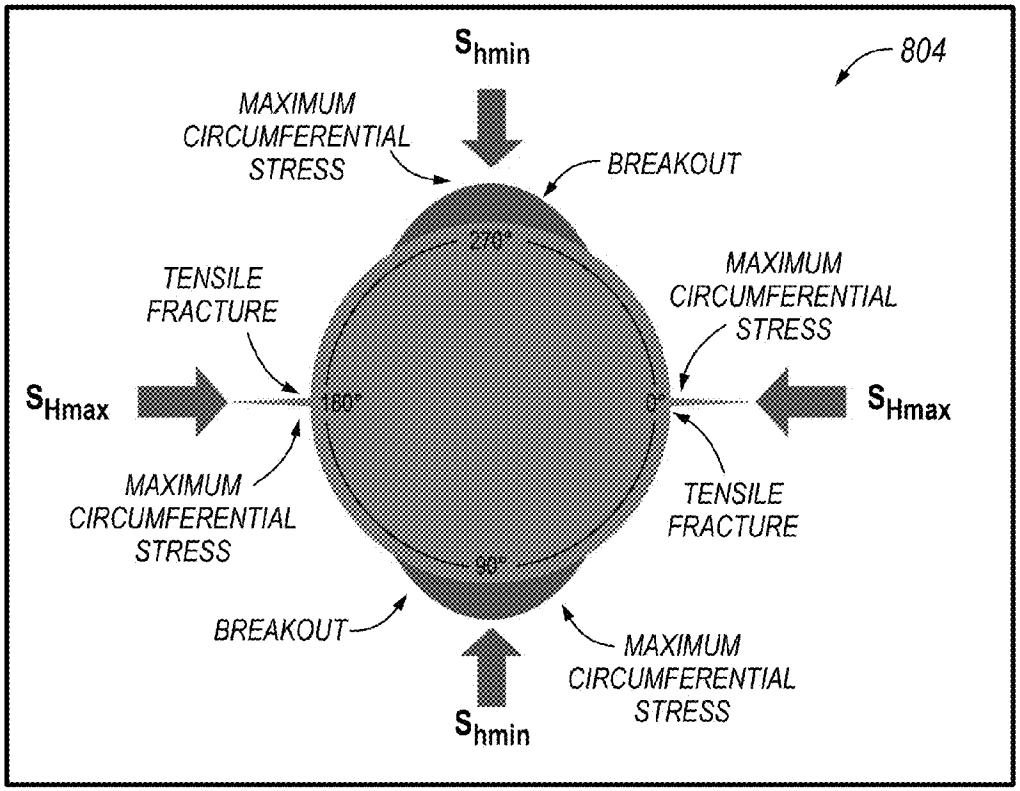
FIGS. 8A and 8B depict the graphical identification of geological features and stresses from a borehole image in accordance with an embodiment of the disclosure.
Figure 8A:
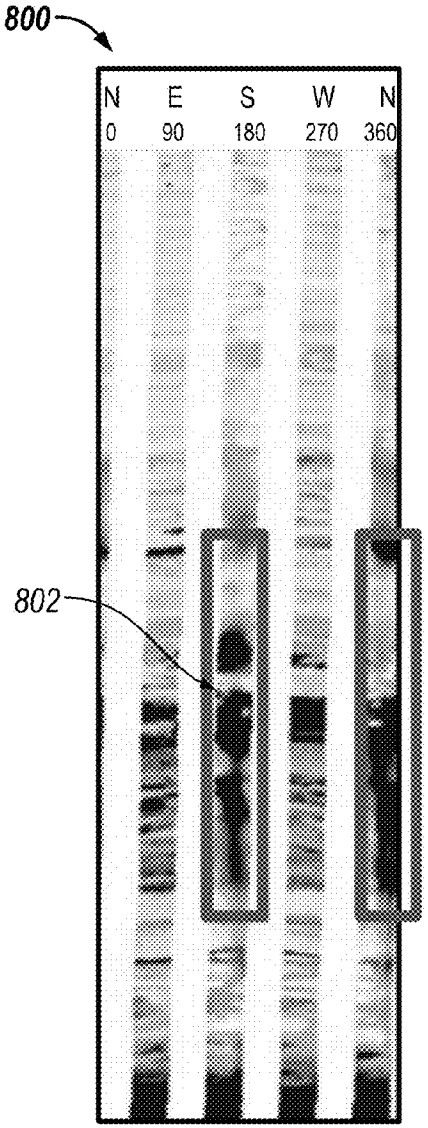

The 3D critical stress analysis (block 110) may also include a determination of the maximum horizontal stress direction (block 122). The determination of maximum horizontal stress direction may include obtaining borehole images and interpreting the borehole images to interpret geological features. In some embodiments, the borehole images may include sonic borehole images, resistive borehole images, or both. The geological features may include natural fractures, drilling tensile inducted fractures, and breakouts. By way of example, FIGS. 8A and 8B depict the graphical identification of geological features and stresses from a borehole image in accordance with an embodiment of the disclosure. FIG. 8A depicts an example resistive borehole image 800 and the identification of breakouts 802 from the image. In another example, FIG. 8B depicts a relationship 804 between minimum horizontal stress ($S_{hmin}$) and maximum horizontal stress ($S_{Hmax}$), minimum and maximum circumferential stresses, and identifiable geological features of tensile fractures and breakouts in accordance with an embodiment of the disclosure.

Figure 9B:
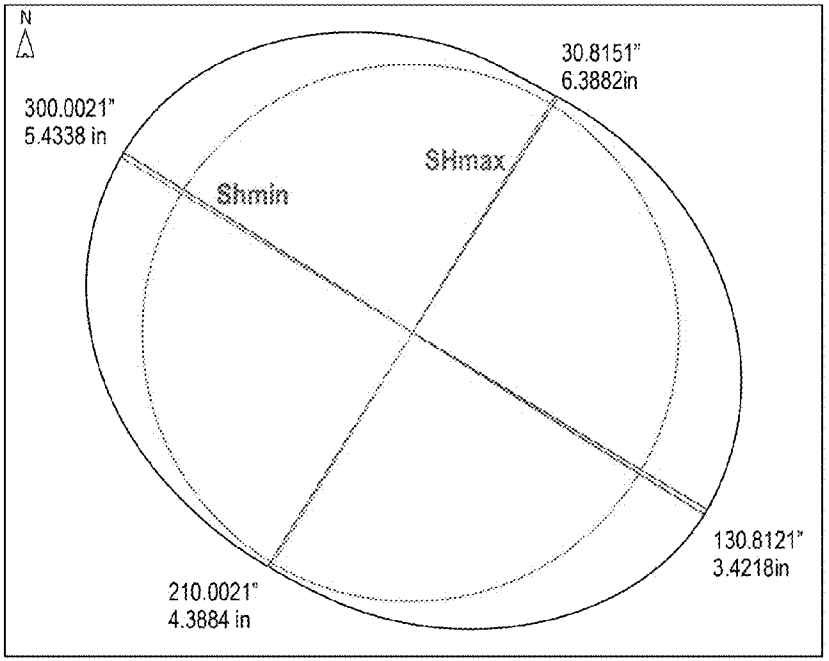
FIGS. 9A and 9B depict the determination of minimum and maximum horizontal stress direction using a multi-arm caliper tool in accordance with an embodiment of the disclosure.
Figure 9A:
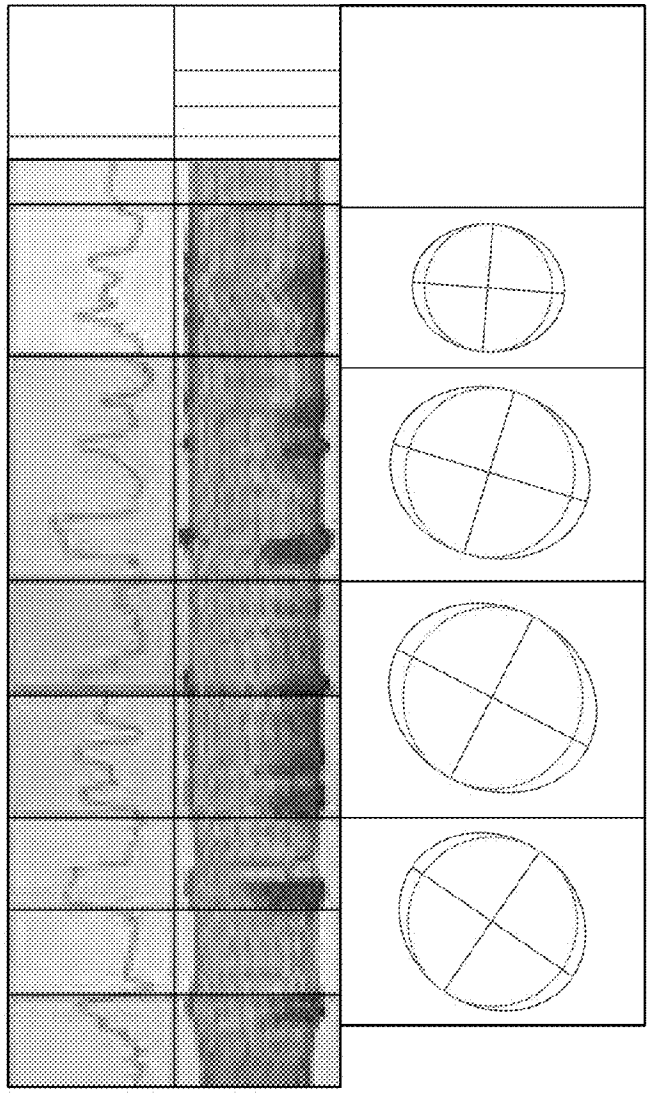
Figure 10:
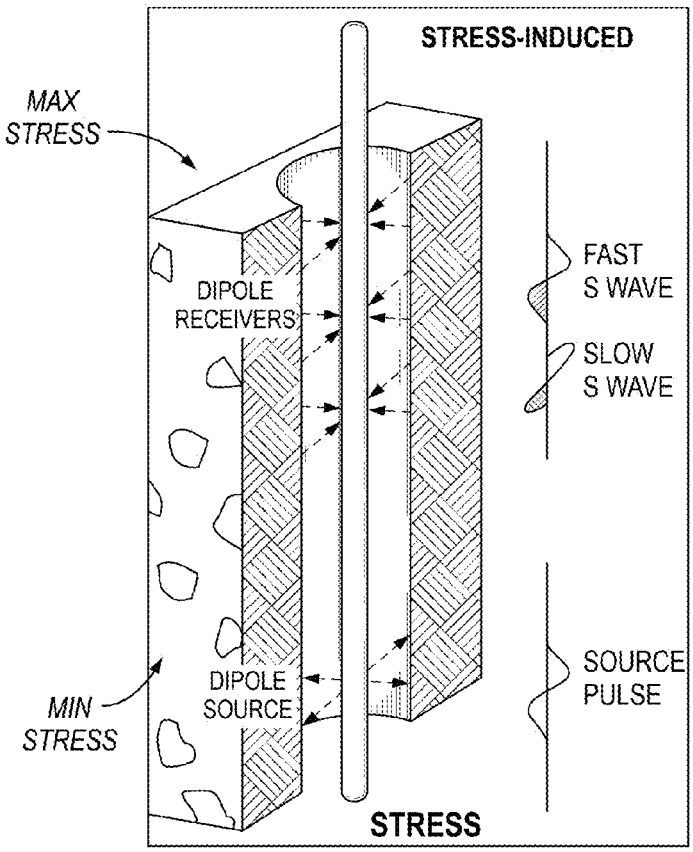
FIG. 10 is a schematic diagram depicting the determination of maximum horizontal stress direction from fast shear anisotropy in accordance with an embodiment of the disclosure.

An in-situ stress direction indicator (for example, an indication of the maximum horizontal stress direction) may be determined. In some embodiments, the in-situ stress direction indicator may be determined from the borehole image used for the natural fracture interpretation. In other embodiments, the in-situ stress direction indicator may be determined using other techniques, such as azimuthal shear anisotropy analysis or multi-arm caliper analysis. By way of example, FIGS. 9A and 9B depict the determination of minimum and maximum horizontal stress direction using a multi-arm caliper tool in accordance with an embodiment of the disclosure. In another example, FIG. 10 is a schematic diagram depicting the determination of maximum horizontal stress direction from fast shear anisotropy in accordance with an embodiment of the disclosure.

As shown in FIG. 1, the process 100 also includes determining a fracture density (block 108). Determining the fracture density (block 108) may include determining a fracture density index (block 124). The fracture density index represents natural fractures as a continuous property, accounting for the shape, geometry, and intensity of the natural fractures within a 3D grid-block model In some embodiments, the fracture density index is determined according to the techniques described in U.S. Publication No. 2023/0313649-A1, published Oct. 5, 2023, and titled "SYSTEM AND METHOD TO DEVELOP NATURALLY FRACTURED HYDROCARBON RESERVOIRS USING A FRACTURE DENSITY INDEX," a copy of which is incorporated by reference in its entirety.

The fracture density index (FDI) represents critical stress fluid pathways in the region of interest. The fracture density index (FDI) determination may include converting the discrete fracture network (into two dimensional (2D) lines to compute a continuous fracture density property, such as described in U.S. Pat. No. 10,607,043, a copy of which is incorporated by reference in its entirety. For example, various geographic information systems (GIS) geoprocessing software may have tools for computing line density. In some embodiments, the conversion of a 3D discrete fracture network to 2D lines may be performed by ArcGIS available from Environmental Systems Research Institute (Ersi), California, USA. In such embodiments, a raster map representing fracture density per area may be generated.

Figure 11A:
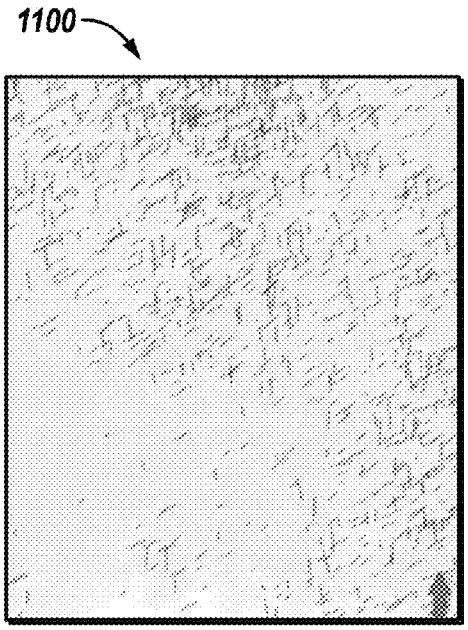
FIG. 11A depicts a 2D fracture network illustrating main fluid pathways in an area in accordance with an embodiment of the disclosure.
Figure 11B:
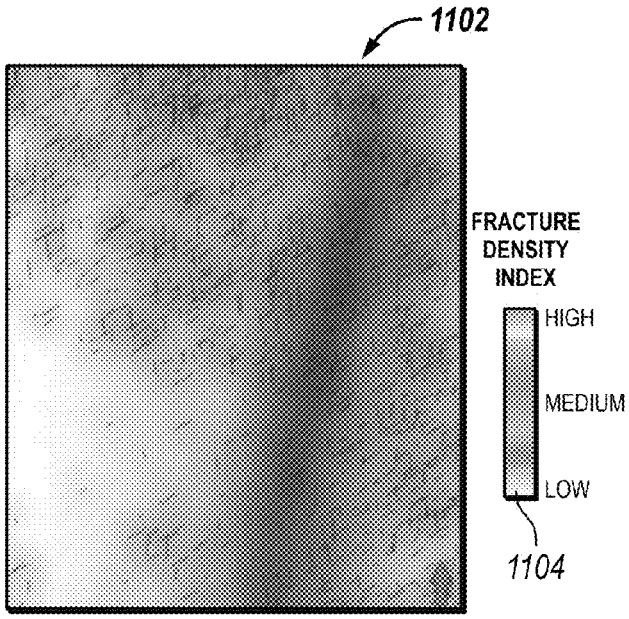
FIG. 11B depicts a line density raster map computed from the 2D fracture network of FIG. 11A in accordance with an embodiment of the disclosure.

FIG. 11A depicts a 2D fracture network 1100 illustrating main fluid pathways in an area in accordance with an embodiment of the disclosure. FIG. 11B depicts a line density raster map 1102 computed from the 2D fracture network of FIG. 11A in accordance with an embodiment of the disclosure. FIG. 11B also includes a legend 1104 that indicates the fracture density index (FDI) according to color-coded values on a continuum of from high, to medium, to low.

Determining the fracture density index (block 108) also includes determining a Coulomb Excessive Failure Function (CEFF) (block 126). The Coulomb-Mohr criteria depend on the stress magnitude and the orientation of the fracture plane with respect to the in-site stress orientation. The stress orientation affects the normal and shear stresses acting in the fracture plane. The CEFF may be determined according to the following:

$$CEFF = (\tau - \sigma_n * \mathrm{Tan}(\varphi))/S_v \tag{6}$$

Figure 12A:
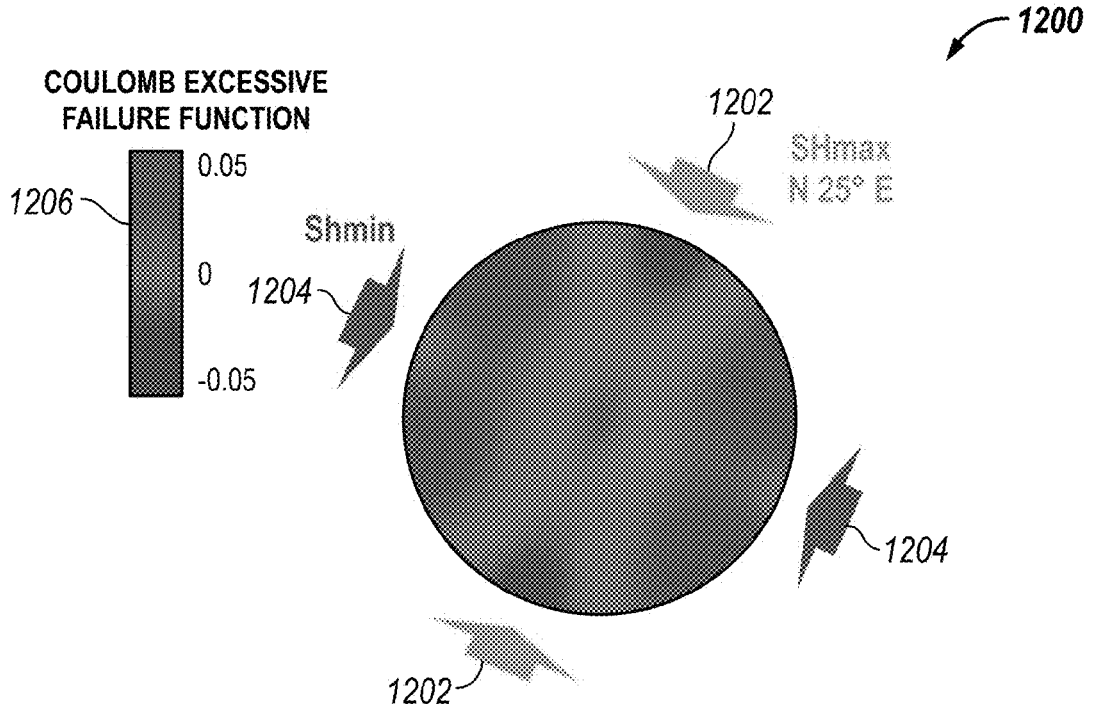
FIG. 12A is a projection that shows the orientation of critically stressed fractures of FIG. 12B, with arrows showing the point of maximum horizontal stress ($S_{Hmax}$) and the point of minimum horizontal stress ($S_{Hmax}$) in accordance with an embodiment of the disclosure.
Figure 12B:
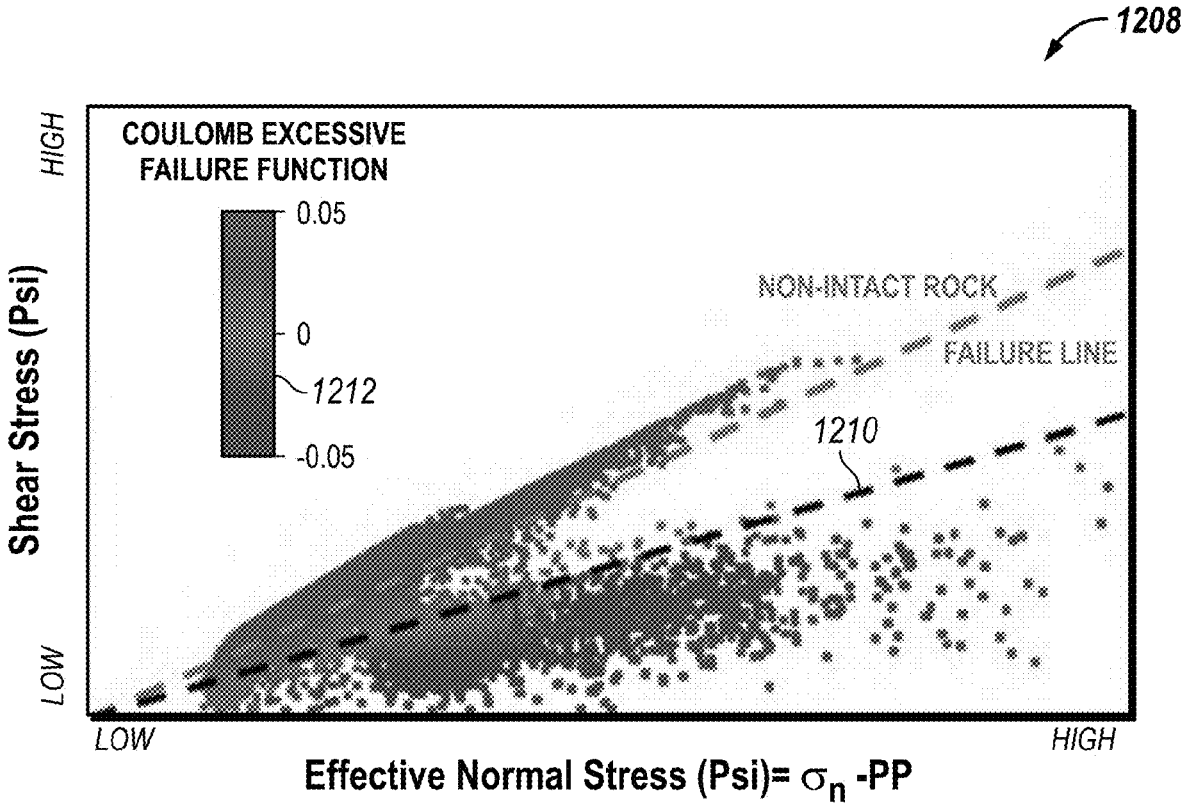
FIG. 12B is a plot of shear stress vs effective normal stress for each fracture plane and that shows a Coulomb Excessive Failure Function (CEFF) value and the critically stressed fractures and non-critically stressed fractures in accordance with an embodiment of the disclosure.

The determination of the CEFF provides an indicator of a fractures that have the potential to be reactivated. Moreover, The largest fracture aperture corresponds to the greatest distance between the points and the failure Mohr Coulomb line (that is, the friction angle for non-intact rock). By way of example, FIG. 12A is a projection 1200 that shows the orientation of critically stressed fractures of FIG. 12B, with arrows 1202 showing the point of maximum horizontal stress ($S_{Hmax}$), arrows 1204 showing the point of minimum horizontal stress ($S_{Hmax}$), and the color legend 1206 corresponding to CEFF values in accordance with an embodiment of the disclosure. FIG. 12B is a plot 1208 of shear stress vs effective normal stress for each fracture plane and that shows the CEFF value and the critically stressed fractures (above the line 1210) and non-critically stressed fractures (below the line 1210) in accordance with an embodiment of the disclosure. As shown in FIG. 12B, fractures with greater CEFF values (that is, red according to the color legend 1212) are relatively close to or above the failure function line. Thus, they represent the fractures having the greatest potential for reactivation (red according to the color legend 1212).

Figure 13B:
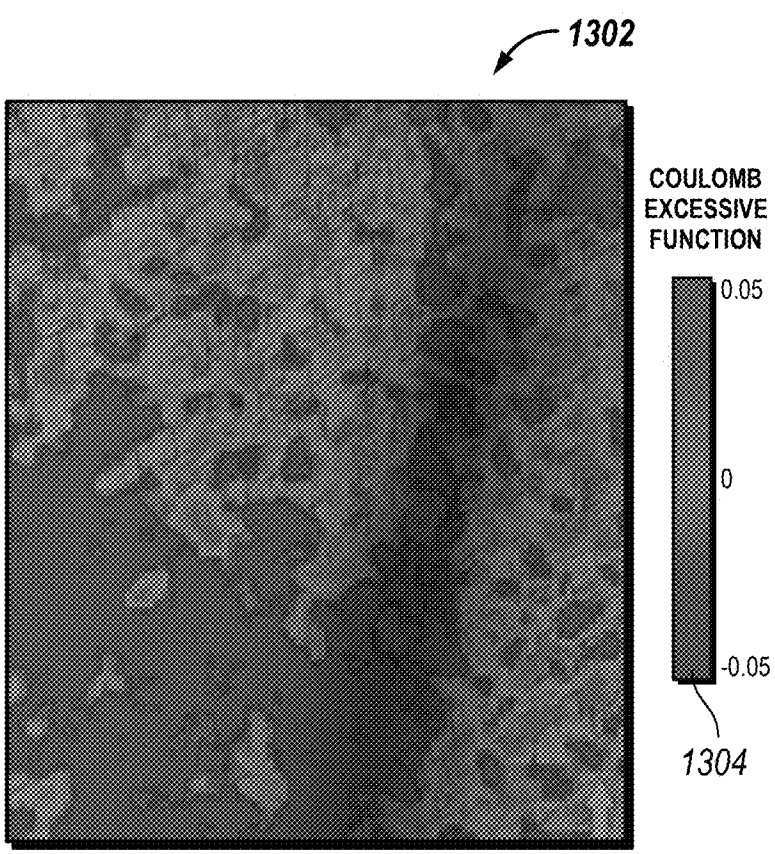
FIG. 13B depicts a fracture reactivation index (FRI) map determined from the FDI map of FIG. 13A in accordance with an embodiment of the disclosure.
Figure 13A:
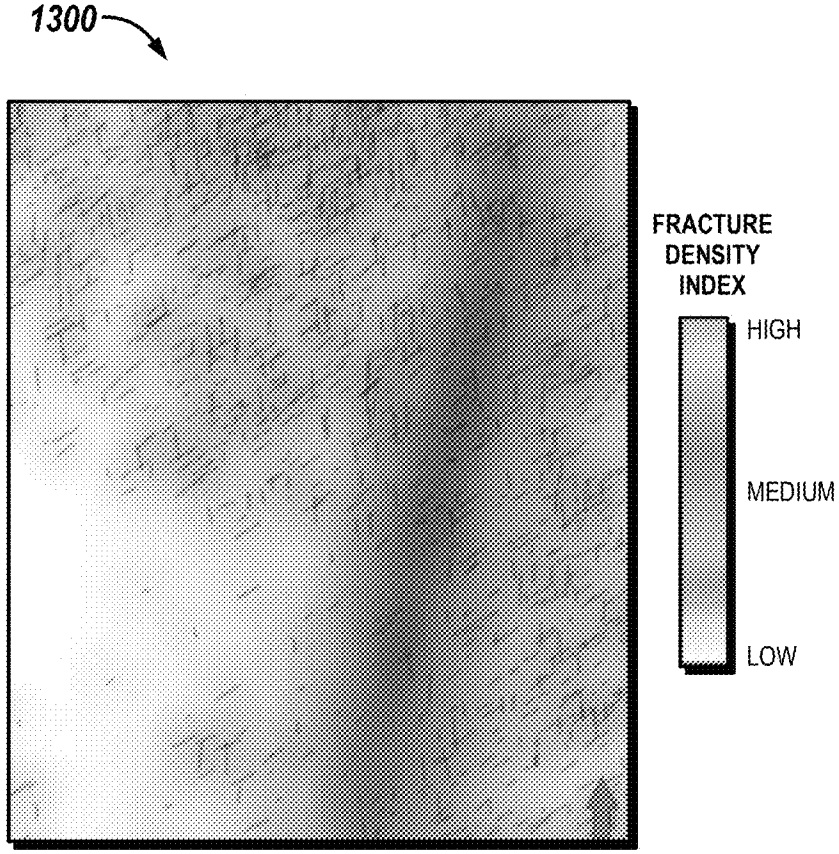
FIG. 13A depicts a fracture density index (FDI) map in accordance with an embodiment of the disclosure.

As shown in FIG. 1, the process 100 may include determining a fracture reactivation index (FRI) (block 110). Determination of the fracture reactivation index may include generating a 3D FRI model and determining caprock integrity (block 128). Generating the 3D FRI model may include representing the CEFF into a 3D grid model by calculating the value of the CEFF over every plane present in the fracture density index (FDI) model. As a result, only the natural fractures that are critically stressed with a corresponding CEFF calculation will be represented in the FRI. For example, FIG. 13A depicts a fracture density index (FDI) map 1300 (as discussed supra and illustrated in FIG. 10B) in accordance with an embodiment of the disclosure. FIG. 13B depicts a fracture reactivation index (FRI) map 1302 determined from the FDI map 1300 using the CEFF described supra in accordance with an embodiment of the disclosure. FIG. 13B also includes a color-coded legend 1304 indicating the CEFF according to values on a continuum from 0.05 to −0.05. The CEFF values of the FRI may indicate areas where $CO_2$ or other injected fluids could leak; these areas are representative of elevated risk for caprock seal integrity problems, thus enabling a determination of caprock integrity. For example, as shown in FIG. 13B, those areas depicted in red on the map (and having a greater CEFF value) represent the fractures having the greatest potential for reactivation and thus those areas having an elevated risk for caprock integrity problems (that is, seal failures in a fluid injection operation).

In some embodiments, the process 100 includes performing a fluid injection based on the FRI (block 130). The process 100 may include designing a fluid injection plan (for example, a $CO_2$ injection plan) in inject fluid far from the areas having elevated risk (as indicated by high CEFF values). A fluid (for example, $CO_2$) may be injected into one or more wells accessing a reservoir represented by the FRI map, with well locations, injection locations, or both determined from the FRI map to avoid areas having an elevated risk for caprock integrity problems.

Figure 14:
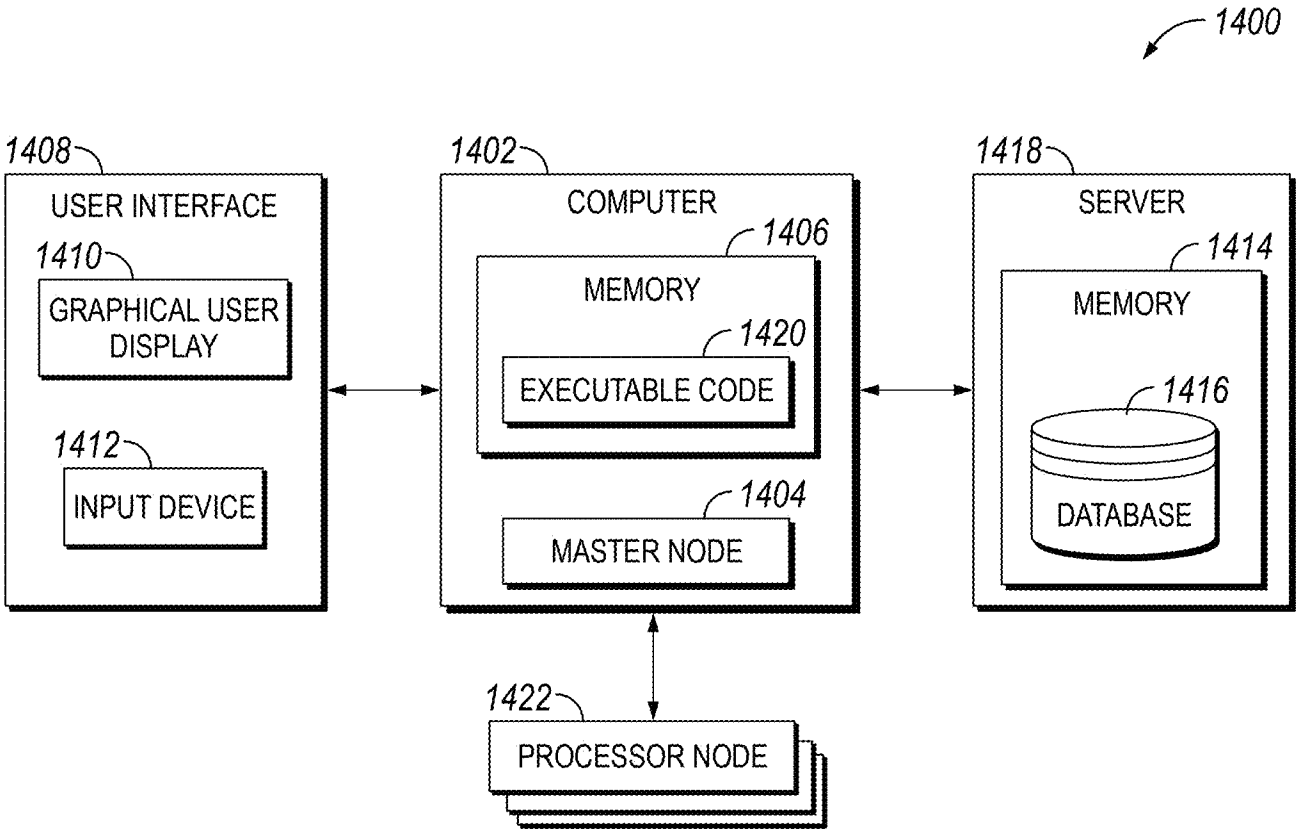
FIG. 14 is a block diagram of a data processing system in accordance with an embodiment of the disclosure.

FIG. 14 depicts a data processing system 1400 that includes a computer 1402 having a master node processor 1404 and memory 1406 coupled to the processor 1404 to store operating instructions, control information and database records therein in accordance with an embodiment of the disclosure. The data processing system 1400 may be a multicore processor with nodes such as those from Intel Corporation or Advanced Micro Devices (AMD), or an HPC Linux cluster computer. The data processing system 1400 may also be a mainframe computer of any conventional type of suitable processing capacity such as those available from International Business Machines (IBM) of Armonk, N.Y., or other source. The data processing system 1400 may in cases also be a computer of any conventional type of suitable processing capacity, such as a personal computer, laptop computer, or any other suitable processing apparatus. It should thus be understood that a number of commercially available data processing systems and types of computers may be used for this purpose.

The computer 1402 is accessible to operators or users through user interface 1408 and are available for displaying output data or records of processing results obtained according to the present disclosure with an output graphic user display 1410. The output display 1410 includes components such as a printer and an output display screen capable of providing printed output information or visible displays in the form of graphs, data sheets, graphical images, data plots and the like as output records or images.

The user interface 1408 of computer 1402 also includes a suitable user input device or input/output control unit 1412 to provide a user access to control or access information and database records and operate the computer 1402. Data processing system 1400 further includes a database of data stored in computer memory, which may be internal memory 1406, or an external, networked, or non-networked memory as indicated at 1414 in an associated database 1416 in a server 1418.

The data processing system 1400 includes executable code 1420 stored in non-transitory memory 1406 of the computer 1402. The executable code 1420 according to the present disclosure is in the form of computer operable instructions causing the data processor 1404 to determine a mechanical earth model, determine a fracture model, perform a 3D critical stress analysis, and determine a fracture density index (FDI) and Coulomb Excessive Failure Function (CEFF) values. Moreover, the computer operable instructions of the executable code 1420 may determine an a fracture reactivation index (FRI) and control fluid injection operations according to the techniques described herein.

It should be noted that executable code 1420 may be in the form of microcode, programs, routines, or symbolic computer operable languages capable of providing a specific set of ordered operations controlling the functioning of the data processing system 1400 and direct its operation. The instructions of executable code 1420 may be stored in memory 1406 of the data processing system 1400, or on computer diskette, magnetic tape, conventional hard disk drive, electronic read-only memory, optical storage device, or other appropriate data storage device having a non-transitory computer readable storage medium stored thereon. Executable code 1420 may also be contained on a data storage device such as server 1418 as a non-transitory computer readable storage medium, as shown.

The data processing system 1400 may be include a single CPU, or a computer cluster as shown in FIG. 14, including computer memory and other hardware to make it possible to manipulate data and obtain output data from input data. A cluster is a collection of computers, referred to as nodes, connected via a network. A cluster may have one or two head nodes or master nodes 1404 used to synchronize the activities of the other nodes, referred to as processing nodes 1422. The processing nodes 1422 each execute the same computer program and work independently on different segments of the grid which represents the reservoir.

Ranges may be expressed in the disclosure as from about one particular value, to about another particular value, or both. When such a range is expressed, it is to be understood that another embodiment is from the one particular value, to the other particular value, or both, along with all combinations within said range.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used in the disclosure are for organizational purposes only and are not meant to be used to limit the scope of the description.

What is claimed is:

1. A method for determining caprock integrity in a subsurface reservoir using a fracture reactivation index (FRI), the method comprising:

determining a principal stress associated with subsurface reservoir, the principal stress determined by a micro-fracturing test;

forming, using a mechanical earth model, a fracture network model to identify the presence and extent of natural fractures at locations in the subsurface hydrocarbon reservoir, wherein the mechanical earth model incorporates the principal stress;

determining, using the discrete fracture network, a fracture density index (FDI), wherein determining the fracture density index (FDI) comprises generating a raster map from the discrete fracture network, the raster map representing a fracture density per area;

determining Coulomb Excessive Failure Function (CEFF) values for natural fractures in the discrete fracture network, the CEFF values determined using a shear stress, a normal stress, a friction angle, a vertical stress; and determining a fracture reactivation index (FRI) using the CEFF values, wherein a subset of CEFF values above a threshold identify a subset of natural fractures having a potential for reactivation due to a failure of caprock integrity;

comprising identifying an area for fluid injection using a map comprising the fracture reactivation index (FRI); and performing a fluid injection into the subsurface reservoir based on the identified area.

2. The method of claim 1, wherein the Coulomb Excessive Failure Function (CEFF) comprises:

$CEFF=(\tau-\sigma_n*\mathrm{Tan}(\varphi))/S_v$, where $\tau$ is the shear stress, $\sigma_n$ is the normal stress, $\varphi$ is the friction angle, and $S_v$ is the vertical stress.

3. The method of claim 1, comprising performing the micro-fracturing test.

4. The method of claim 1, wherein the fluid is carbon dioxide ($CO_2$).

5. The method of claim 1, wherein determining the principal stress associated with subsurface reservoir comprises determining a fracture closure pressure using the micro-fracturing test.

6. A non-transitory computer-readable storage medium having executable code stored thereon for determining caprock integrity in a subsurface reservoir using a fracture reactivation index (FRI), the executable code comprising a set of instructions that causes a processor to perform operations comprising:

determining a principal stress associated with subsurface reservoir, the principal stress determined by a micro-fracturing test;

forming, using a mechanical earth model, a fracture network model to identify the presence and extent of natural fractures at locations in the subsurface hydrocarbon reservoir, wherein the mechanical earth model incorporates the principal stress;

determining, using the discrete fracture network, a fracture density index (FDI), wherein determining the fracture density index (FDI) comprises generating a raster map from the discrete fracture network, the raster map representing a fracture density per area;

determining Coulomb Excessive Failure Function (CEFF) values for natural fractures in the discrete fracture network, the CEFF values determined using a shear stress, a normal stress, a friction angle, a vertical stress; and determining a fracture reactivation index (FRI) using the CEFF values, wherein a subset of CEFF values above a threshold identify a subset of natural fractures having a potential for reactivation due to a failure of caprock integrity;

comprising identifying an area for fluid injection using a map comprising the fracture reactivation index (FRI); and controlling a fluid injection into the subsurface reservoir based on the identified area.

7. The non-transitory computer-readable storage medium of claim 6, wherein the Coulomb Excessive Failure Function (CEFF) comprises:

$CEFF=(\tau-\sigma_n*\mathrm{Tan}(\varphi))/S_v$, where $\tau$ is the shear stress, $\sigma_n$ is the normal stress, $\varphi$ is the friction angle, and $S_v$ is the vertical stress.

8. The non-transitory computer-readable storage medium of claim 6, wherein the fluid is carbon dioxide ($CO_2$).

9. The non-transitory computer-readable storage medium of claim 6, wherein determining the principal stress associated with subsurface reservoir comprises determining a fracture closure pressure using the micro-fracturing test.

10. A system for determining caprock integrity in a subsurface reservoir using a fracture reactivation index (FRI), comprising:

a processor;

a non-transitory computer-readable memory accessible by the processor and having executable code stored thereon, the executable code comprising a set of instructions that causes a processor to perform operations comprising:

determining a principal stress associated with subsurface reservoir, the principal stress determined by a micro-fracturing test;

forming, using a mechanical earth model, a fracture network model to identify the presence and extent of natural fractures at locations in the subsurface hydrocarbon reservoir, wherein the mechanical earth model incorporates the principal stress;

determining, using the discrete fracture network, a fracture density index (FDI), wherein determining the fracture density index (FDI) comprises generating a raster map from the discrete fracture network, the raster map representing a fracture density per area;

determining Coulomb Excessive Failure Function (CEFF) values for natural fractures in the discrete fracture network, the CEFF values determined using a shear stress, a normal stress, a friction angle, a vertical stress; and determining a fracture reactivation index (FRI) using the CEFF values, wherein a subset of CEFF values above a threshold identify a subset of natural fractures having a potential for reactivation due to a failure of caprock integrity;

comprising identifying an area for fluid injection using a map comprising the fracture reactivation index (FRI); and controlling a fluid injection into the subsurface reservoir based on the identified area.

11. The system of claim 10, wherein the Coulomb Excessive Failure Function (CEFF) comprises:

$CEFF=(\tau-\sigma_n*Tan(\varphi))/S_v$, where $\tau$ is the shear stress, $\sigma_n$ is the normal stress, $\varphi$ is the friction angle, and $S_v$ is the vertical stress.

12. The system of claim 10, comprising controlling the micro-fracturing test.

13. The system of claim 10, wherein the fluid is carbon dioxide ($CO_2$).

14. The system of claim 10, wherein determining the principal stress associated with subsurface reservoir comprises determining a fracture closure pressure using the micro-fracturing test.

* * * * *